US008771011B2

(12) United States Patent
Ball

(10) Patent No.: US 8,771,011 B2
(45) Date of Patent: Jul. 8, 2014

(54) BROADBAND INTERFACE CONNECTION SYSTEM

(76) Inventor: David J Ball, Hudson, WI (US)

( * ) Notice: Subject to any disclaimer, the term of this patent is extended or adjusted under 35 U.S.C. 154(b) by 42 days.

(21) Appl. No.: 13/551,758

(22) Filed: Jul. 18, 2012

(65) Prior Publication Data

US 2013/0023152 A1 Jan. 24, 2013

Related U.S. Application Data

(60) Provisional application No. 61/509,218, filed on Jul. 19, 2011.

(51) Int. Cl.
*H01R 9/05* (2006.01)

(52) U.S. Cl.
USPC ..... 439/579

(58) Field of Classification Search
USPC ..... 439/579, 578, 584; 174/89
See application file for complete search history.

(56) References Cited

U.S. PATENT DOCUMENTS

| | | | | |
|---|---|---|---|---|
| 4,156,554 | A * | 5/1979 | Aujla | 439/584 |
| 5,352,134 | A | 10/1994 | Jacobsen et al. | |
| 6,102,738 | A * | 8/2000 | Macek et al. | 439/584 |
| 6,208,219 | B1 | 3/2001 | Singer | |
| 6,884,115 | B2 * | 4/2005 | Malloy | 439/584 |
| 6,978,474 | B1 | 12/2005 | Sheppard et al. | |
| 7,153,160 | B2 | 12/2006 | Montena | |
| 7,171,505 | B2 | 1/2007 | Kuhlmann et al. | |
| 7,200,156 | B2 | 4/2007 | Skarpness | |
| 7,252,546 | B1 | 8/2007 | Holland et al. | |
| 7,300,309 | B2 | 11/2007 | Montena | |
| 7,347,728 | B2 | 3/2008 | Montena | |
| 7,404,738 | B2 * | 7/2008 | Montena | 439/579 |
| 7,563,996 | B2 | 7/2009 | Loeffelholz et al. | |
| 7,674,132 | B1 | 3/2010 | Chen | |
| 7,714,229 | B2 | 5/2010 | Burris et al. | |
| 7,794,275 | B2 | 9/2010 | Rodrigues | |
| 7,931,498 | B2 | 4/2011 | Skeels et al. | |
| 7,950,958 | B2 | 5/2011 | Mathews | |
| 7,950,961 | B2 * | 5/2011 | Chabalowski et al. | 439/584 |
| 7,972,172 | B2 | 7/2011 | Huang et al. | |
| 7,972,175 | B2 | 7/2011 | Chawgo | |
| 2003/0224657 | A1 | 12/2003 | Malloy | |
| 2008/0184553 | A1 | 8/2008 | Burris | |
| 2009/0069051 | A1 | 3/2009 | Jain et al. | |
| 2009/0172208 | A1 | 7/2009 | Lee et al. | |
| 2011/0086543 | A1 | 4/2011 | Alrutz et al. | |
| 2011/0117775 | A1 | 5/2011 | Alrutz | |
| 2011/0117777 | A1 | 5/2011 | Thomas et al. | |
| 2011/0117778 | A1 | 5/2011 | Xie | |
| 2011/0151713 | A1 | 6/2011 | Yang | |

* cited by examiner

*Primary Examiner* — Alexander Gilman
(74) *Attorney, Agent, or Firm* — Mitchell A. Rossman; Terra Nova Patent Law, PLLC.

(57) ABSTRACT

The present invention provides a universal broadband interface connection system, which increases the reliability of a drop system. The present invention provides a cable connection system including a nut assembly including a nut and a donut; a slug assembly including a first sleeve, a second sleeve, and a ferrule; and a port assembly including a port and an insulative ring.

20 Claims, 26 Drawing Sheets

BROADBAND INTERFACE CONNECTION SYSTEM

RELATED APPLICATIONS

This application claims priority to U.S. Provisional Patent Application Ser. No. 61/509,218 filed Jul. 19, 2011, which is hereby incorporated by reference in its entirety for all purposes.

BACKGROUND OF THE INVENTION

All drop systems starting from a distribution system including a satellite dish, a CATV distribution system, and a traditional telephone system have the same purpose of faithfully transmitting RF energy from the distribution system to a television, a cable modem, or other devices to which the RF energy is directed.

Within a drop system, there are points in the cable lines where either passive or active devices are inserted for a variety of purposes. Ground blocks may be inserted to provide a grounding point designed to provide electrical safety from voltage surges. Splitters and diplexers may be inserted to split a RF signal from a single cable to a number of cables to distribute the RF signal to a multitude of devices within a dwelling, or filter certain portions of RF signal's spectra. Amplifiers may be inserted to boost signal levels. Splice fittings may be inserted to repair or replace a damaged cable.

At the end of the drop system, the cable may be terminated into a variety of devices including set top boxes, cable modems, etc. designed to produce a final product, namely voice, video, or data.

Where each of the devices as described above is inserted into the cable lines, there are connections to be made between the cable and the inserted devices. In the conventional method of making these connections, an inserted device having threaded female ports, which accept F male connectors with a protruding center conductor, is used. These connections serve the following purposes. The first purpose is to provide an electrically compatible transition from the cable to the device being inserted. The cable sizes vary from RG-59 to RG-11 sized braided cables. The second is to protect an electrical connection from the environment by sealing the connection from moisture, dust, and other elements, which might degrade an electrical path. The third is to keep RF energy confined in the transmission system and to keep external signals from entering the transmission system. The fourth is to maintain a mechanically strong connection. The mechanically strong connection will maintain an electrical connection despite external mechanical forces. The fifth is to allow the inserted devices to be connected and disconnected repeatedly for the purposes of system maintenance, upgrades, and alterations. These connections between the cable and the inserted devices are a constant source of maintenance and reliability issues for the service providers. For example, metallic incompatibility may occur in the form of galvanic reactions, and accelerated corrosion. The connections between the cable and the inserted devices may be susceptible to improper torque of the nut by the craftsperson allowing for degradation of the outer conductor performance, and the ingress/egress of electrical signals. Poor performance may occur over time due to the fact that there are generally three electrical connections made with the standard feed through connector, and up to four connections made with a captivated pin type connector. Each connector must be installed with its corresponding seal ring. Using other manufacturer's seal rings will reduce its effectiveness in sealing the connections.

This may create compatibility issues, and the need to maintain stock organization. Moreover, compression tools are not always compatible between connector manufacturers and specific tools for each connector type used are required.

To increase the reliability of the drop system, a connection, which eliminates these issues, is required. These issues may be eliminated by, for example, encapsulating the electrical connections, reducing the number of electrical connections made, simplifying and standardizing the installation process, and eliminating dissimilar metal issues.

SUMMARY OF THE INVENTION

The present invention provides a universal broadband interface connection system, which increases the reliability of a drop system. The present invention provides a cable connection system including a nut assembly including a nut and a donut; a slug assembly including a first sleeve, a second sleeve, and a ferrule; and a port assembly including a port and an insulative ring.

The present invention provides a cable connection system. The cable connection system includes: a nut assembly including: a nut having a first end, a second end, one or more exterior surfaces, a first interior surface, a second interior surface, and a third interior surface, wherein the first interior surface of the nut is adjacent the first end and configured to accept a coaxial cable, wherein the second interior surface of the nut is between the first interior surface and the third interior surface, wherein the third interior surface of the nut is adjacent the second end and includes a first thread; and a donut having a first end, a second end, one or more exterior surfaces, and an interior surface, wherein the interior surface of the donut is configured to accept the coaxial cable, wherein the one or more exterior surfaces of the donut are configured to accept the second interior surface of the nut; a slug assembly including: a first sleeve having a first end, a second end, one or more exterior surfaces, and an interior surface; wherein the interior surface of the first sleeve is configured to accept the coaxial cable; wherein the first sleeve includes an exterior projection on the one or more exterior surfaces adjacent the second end; a second sleeve having a first end, a second end, one or more exterior surfaces, a first interior surface, a second interior surface, and a third interior surface, wherein the first interior surface of the second sleeve is adjacent the first end; wherein the second interior surface of the second sleeve is between the first interior surface and the third interior surface, wherein the second interior surface of the second sleeve is configured to accept the exterior projection of the first sleeve: wherein the third interior surface of the second sleeve is adjacent the second end and configured to accept the coaxial cable; and a ferrule having a first end, a second end, one or more exterior surfaces, and an interior surface, wherein the ferrule includes an exterior projection on the one or more exterior surfaces adjacent the first end, wherein the interior surface of the ferrule is configured to accept the one or more exterior surfaces of the first sleeve, wherein the one or more exterior surfaces of the ferrule are configured to accept the first interior surface of the second sleeve; and a port assembly including: a port having a first end, a second end, one or more exterior surfaces, a first interior surface, a second interior surface, a third interior surface, and a fourth interior surface, wherein the one or more exterior surfaces adjacent the first end of the port each independently include a second thread configured to accept the first thread of the nut, wherein the first interior surface of the port is adjacent the first end and configured to accept the one or more exterior surfaces of the second sleeve; wherein the second interior surface of the port is between the first interior surface and the third interior surface adjacent the second end, wherein the third interior surface of the port is between the second interior surface and the fourth interior surface adjacent the second end, wherein the fourth interior surface of the port is adjacent the second end of the port; and an insulative ring having a first end, a second end, one or more exterior surfaces, and an interior surface; wherein the one or more exterior surfaces of the insulative ring are configured to accept the second interior surface of the port; wherein the interior surface of the insulative ring is configured to accept and allow for the protrusion of a central conductor electrode in the coaxial cable from the second end of the insulative ring through the third interior surface of the port and the second end of the port.

In one embodiment, the nut includes a wrench flat or a knurled outer surface on the one or more exterior surfaces adjacent the first end. In one embodiment, the first interior surface of the nut is configured with a smooth bore to accept a coaxial cable. In one embodiment, the interior surface of the donut is configured with a smooth bore to accept the coaxial cable.

In one embodiment, the donut includes an exterior projection on the one or more exterior surfaces adjacent the first end. In one embodiment, the interior surface of the first sleeve is configured with a smooth bore to accept the coaxial cable. In one embodiment, the third interior surface of the second sleeve is adjacent the second end and configured with a smooth bore to accept the coaxial cable. The cable connection system of claim 1, wherein one or more exterior surfaces of the second sleeve each independently include one or more external projections each independently projected from the first end to the second end.

In one embodiment, the one or more external projections on the one or more exterior surfaces of the second sleeve each independently include four external projections. In one embodiment, the four external projections on the one or more exterior surfaces of the second sleeve each independently project from each other at an angle of ninety degrees. In one embodiment, the first interior surface of the second sleeve includes a third thread configured to accept a fourth thread on the one or more exterior surfaces of the ferrule. In one embodiment, the second interior surface of the port is configured to accept the one or more external projections of the second sleeve.

In one embodiment, the second interior surface of the port includes one or more indentations each independently configured to accept the one or more external projections of the second sleeve. In one embodiment, the one or more indentations on the second interior surface of the port are at an angle of ninety degrees from each other. In one embodiment, the interior surface of the insulative ring is tapered to allow for the protrusion of a central conductor electrode in the coaxial cable from the second end of the insulative ring through the third interior surface of the port and the second end of the port.

In one embodiment, the diameter inside the first interior surface of the port is greater than the diameter inside the second interior surface of the port. In one embodiment, the diameter inside the second interior surface of the port is greater than the diameter inside the third interior surface of the port. In one embodiment, the diameter inside the third interior surface of the port is greater than the diameter inside the fourth interior surface of the port. In one embodiment, the diameter inside the second interior surface of the port is greater than the diameter inside the third interior surface of the port. In one embodiment, the port includes a wrench flat or a knurled outer surface on the one or more exterior surfaces.

The present invention provides a cable connection system. The cable connection system includes: a nut assembly including: a nut having a first end, a second end, one or more exterior surfaces, a first interior surface, a second interior surface, and a third interior surface, wherein the first interior surface of the nut is adjacent the first end and configured with a smooth bore to accept a coaxial cable, wherein the second interior surface of the nut is between the first interior surface and the third interior surface, wherein the third interior surface of the nut is adjacent the second end and includes a first thread, wherein the nut includes a wrench flat or a knurled outer surface on the one or more exterior surfaces adjacent the first end; and a donut having a first end, a second end, one or more exterior surfaces, and an interior surface, wherein the interior surface of the donut is configured with a smooth bore to accept the coaxial cable, wherein the one or more exterior surfaces of the donut are configured to accept the second interior surface of the nut, wherein the donut includes an exterior projection on the one or more exterior surfaces adjacent the first end; a slug assembly including: a first sleeve having a first end, a second end, one or more exterior surfaces, and an interior surface; wherein the interior surface of the first sleeve is configured with a smooth bore to accept the coaxial cable; wherein the first sleeve includes an exterior projection on the one or more exterior surfaces adjacent the second end; a second sleeve having a first end, a second end, one or more exterior surfaces, a first interior surface, a second interior surface, and a third interior surface, wherein the first interior surface of the second sleeve is adjacent the first end; wherein the second interior surface of the second sleeve is between the first interior surface and the third interior surface, wherein the second interior surface of the second sleeve is configured to accept the exterior projection of the first sleeve: wherein the third interior surface of the second sleeve is adjacent the second end and configured with a smooth bore to accept the coaxial cable, wherein one or more exterior surfaces of the second sleeve each independently include one or more external projections each independently projected from the first end to the second end; and a ferrule having a first end, a second end, one or more exterior surfaces, and an interior surface; wherein the ferrule includes an exterior projection on the one or more exterior surfaces adjacent the first end, wherein the interior surface of the ferrule is configured to accept the one or more exterior surfaces of the first sleeve, wherein the one or more exterior surfaces of the ferrule are configured with a smooth bore to accept the first interior surface of the second sleeve; and a port assembly including: a port having a first end, a second end, one or more exterior surfaces, a first interior surface, a second interior surface, a third interior surface, and a fourth interior surface, wherein the one or more exterior surfaces adjacent the first end of the port each independently include a second thread configured to accept the first thread of the nut, wherein the first interior surface of the port is adjacent the first end and configured to accept the one or more exterior surfaces of the second sleeve; wherein the second interior surface of the port is between the first interior surface and the third interior surface adjacent the second end, wherein the third interior surface of the port is between the second interior surface and the fourth interior surface adjacent the second end, wherein the fourth interior surface of the port is adjacent the second end of the port, wherein the second interior surface of the port is configured to accept the one or more external projections of the second sleeve; and an insulative ring having a first end, a second end, one or more exterior surfaces, and an interior surface; wherein the one or more exterior surfaces of the insulative ring are configured with a smooth bore to accept the second interior surface of the port; wherein the interior surface of the insulative ring is tapered to allow for the protrusion of a central conductor electrode in the coaxial cable from the second end of the insulative ring through the third interior surface of the port and the second end of the port.

In one embodiment, the one or more external projections on the one or more exterior surfaces of the second sleeve each independently include four external projections. In one embodiment, the four external projections on the one or more exterior surfaces of the second sleeve each independently project from each other at an angle of ninety degrees. In one embodiment, the first interior surface of the second sleeve includes a third thread configured to accept a fourth thread on the one or more exterior surfaces of the ferrule. In one embodiment, the second interior surface of the port includes one or more indentations each independently configured to accept the one or more external projections of the second sleeve. In one embodiment, the one or more indentations on the second interior surface of the port are at an angle of ninety degrees from each other.

The present invention provides a cable connection system. The cable connection system includes: a nut assembly including: a nut having a first end, a second end, one or more exterior surfaces, a first interior surface, a second interior surface, and a third interior surface, wherein the first interior surface of the nut is adjacent the first end and configured with a smooth bore to accept a coaxial cable, wherein the second interior surface of the nut is between the first interior surface and the third interior surface, wherein the third interior surface of the nut is adjacent the second end and includes a first thread, wherein the nut includes a wrench flat or a knurled outer surface on the one or more exterior surfaces adjacent the first end; and a donut having a first end, a second end, one or more exterior surfaces, and an interior surface, wherein the interior surface of the donut is configured with a smooth bore to accept the coaxial cable, wherein the one or more exterior surfaces of the donut are configured to accept the second interior surface of the nut, wherein the donut includes an exterior projection on the one or more exterior surfaces adjacent the first end; a slug assembly including: a first sleeve having a first end, a second end, one or more exterior surfaces, and an interior surface; wherein the interior surface of the first sleeve is configured with a smooth bore to accept the coaxial cable; wherein the first sleeve includes an exterior projection on the one or more exterior surfaces adjacent the second end; a second sleeve having a first end, a second end, one or more exterior surfaces, a first interior surface, a second interior surface, and a third interior surface, wherein the first interior surface of the second sleeve is adjacent the first end; wherein the second interior surface of the second sleeve is between the first interior surface and the third interior surface, wherein the second interior surface of the second sleeve is configured to accept the exterior projection of the first sleeve: wherein the third interior surface of the second sleeve is adjacent the second end and configured with a smooth bore to accept the coaxial cable, wherein the one or more external projections on the one or more exterior surfaces of the second sleeve each independently include four external projections each independently projecting from each other at an angle of ninety degrees; and a ferrule having a first end, a second end, one or more exterior surfaces, and an interior surface; wherein the ferrule includes an exterior projection on the one or more exterior surfaces adjacent the first end, wherein the interior surface of the ferrule is configured to accept the one or more exterior surfaces of the first sleeve, wherein the one or more exterior surfaces of the ferrule are configured with a smooth bore to accept the first interior surface of the second sleeve; and a port assembly including: a port having a first end, a second end, one or more exterior surfaces, a first interior surface, a second interior surface, a third interior surface, and a fourth interior surface, wherein the one or more exterior surfaces adjacent the first end of the port each independently include a second thread configured to accept the first thread of the nut, wherein the first interior surface of the port is adjacent the first end and configured to accept the one or more exterior surfaces of the second sleeve; wherein the second interior surface of the port is between the first interior surface and the third interior surface adjacent the second end, wherein the third interior surface of the port is between the second interior surface and the fourth interior surface adjacent the second end, wherein the fourth interior surface of the port is adjacent the second end of the port, wherein the second interior surface of the port is configured to accept the one or more external projections of the second sleeve, wherein the second interior surface of the port includes one or more indentations each independently at an angle of ninety degrees from each other and configured to accept the one or more external projections of the second sleeve; and an insulative ring having a first end, a second end, one or more exterior surfaces, and an interior surface; wherein the one or more exterior surfaces of the insulative ring are configured with a smooth bore to accept the second interior surface of the port; wherein the interior surface of the insulative ring is tapered to allow for the protrusion of a central conductor electrode in the coaxial cable from the second end of the insulative ring through the third interior surface of the port and the second end of the port, wherein the first interior surface of the second sleeve includes a third thread configured to accept a fourth thread on the one or more exterior surfaces of the ferrule.

BRIEF DESCRIPTION OF THE DRAWINGS

Embodiments of the invention may be best understood by referring to the following description and accompanying drawings, which illustrate such embodiments. In the drawings.

Figure 1A:
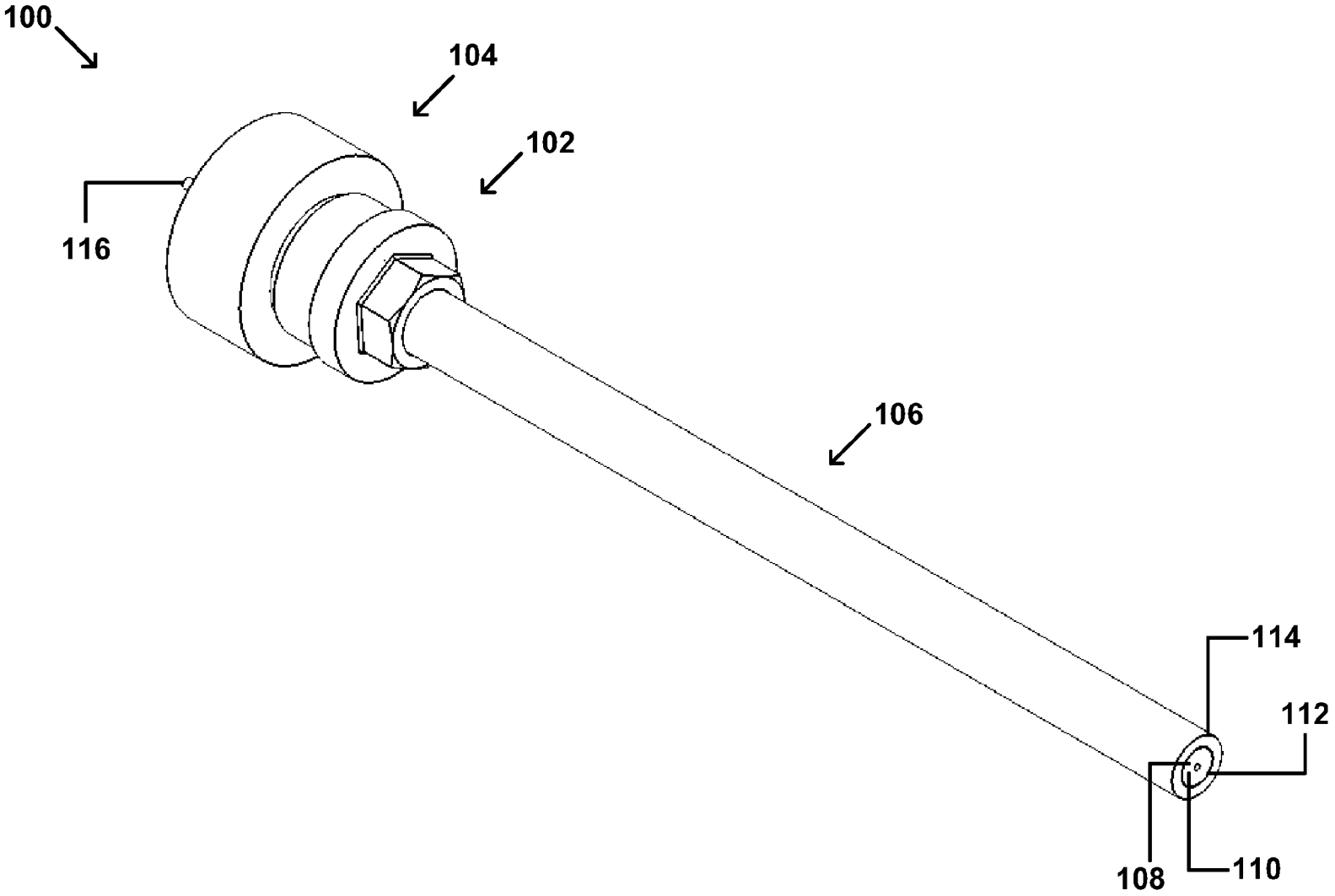
FIG. 1A is a perspective view of an exemplary cable connection system with a coaxial cable inserted therein.

The drawings are not necessarily to scale. Like numbers used in the figures refer to like components, steps, and the like. However, it will be understood that the use of a number to refer to a component in a given figure is not intended to limit the component in another figure labeled with the same number.

DETAILED DESCRIPTION OF THE INVENTION

The present invention provides a universal broadband interface connection system, which increases the reliability of a drop system. The present invention provides a cable connection system including a nut assembly including a nut and a donut; a slug assembly including a first sleeve, a second sleeve, and a ferrule; and a port assembly including a port and an insulative ring.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense, and the scope of the present invention is defined by the appended claims and their equivalents.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the claims made herein.

Methods recited herein may be carried out in any order of the recited events which is logically possible, as well as the recited order of events. Furthermore, where a range of values is provided, it is understood that every intervening value, between the upper and lower limit of that range and any other stated or intervening value in that stated range is encompassed within the invention. Also, it is contemplated that any optional feature of the inventive variations described may be set forth and claimed independently, or in combination with any one or more of the features described herein.

The referenced items are provided solely for their disclosure prior to the filing date of the present application. Nothing herein is to be construed as an admission that the present invention is not entitled to antedate such material by virtue of prior invention.

Unless otherwise indicated, the words and phrases presented in this document have their ordinary meanings to one of skill in the art. Such ordinary meanings can be obtained by reference to their use in the art and by reference to general and scientific dictionaries, for example, *Webster's Third New International Dictionary*, Merriam-Webster Inc., Springfield, Mass., 1993 and *The American Heritage Dictionary of the English Language*, Houghton Mifflin, Boston Mass., 1981.

The following explanations of certain terms are meant to be illustrative rather than exhaustive. These terms have their ordinary meanings given by usage in the art and in addition include the following explanations.

As used herein, the term "about" refers to a variation of 10 percent of the value specified; for example about 50 percent carries a variation from 45 to 55 percent.

As used herein, the term "and/or" refers to any one of the items, any combination of the items, or all of the items with which this term is associated.

As used herein, the singular forms "a," "an," and "the" include plural reference unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation.

As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative apparatus. These terms are not meant to limit the element which they describe, as the various elements may be oriented differently in various applications.

FIG. 1A is a perspective view of an exemplary cable connection system 100 with a coaxial cable inserted therein. The cable connection system 100 is for hard-line or semi-rigid coaxial cables. The cable connection system 100 includes, for example, a nut assembly 102, a slug assembly (not shown), and a port assembly 104 that are configured to be removably connected while providing both an electrical and mechanical connection between the nut assembly 102, the slug assembly (not shown), and the port assembly 104.

The coaxial cable 106 includes, for example, a solid center conductor 108 capable for providing electrical signals there through. The center conductor 108 is typically formed, for example, from a conductive metal, for example, copper, copper clad aluminum, copper clad steel, and the like, or combinations thereof.

Surrounding the cable center conductor 108 is a cable dielectric 110, which insulates the cable center conductor 108 to minimize signal loss. The cable dielectric 110 also maintains spacing between the cable center conductor 108 and a laminated shield tape (LST) 112. The cable dielectric 110 is often a plastic material, for example, a polyethylene, a fluorinated plastic material, for example, a polyethylene or a polytetrafluoroethylene, a fiberglass braid and the like. The laminated shield tape (LST) 112 is typically made of metal, for example, aluminum or steel, and is often extruded to form a hollow tubular structure with a solid wall having a smooth exterior surface. An insulated cable jacket 114 surrounds the laminated shield tape (LST) 112 to further seal the coaxial cable 106 and is typically made of plastic, for example, polyvinylchloride, polyethylene, polyurethane, polytetrafluoroethylene, and the like, or combinations thereof.

The structure of the cable connection system 100 includes a plurality of components generally having a coaxially configuration about an axis defined by the center conductor 108 of the coaxial cable 106. In describing the structure of the cable connection system 100 and the individual components therein, the terms "first end" and "second end" refer to the right side and left side of the cable connection system 100 and the components thereof, respectively, as shown in FIG. 1A. The axis of the cable connection system 100 refers to the axis generally defined by the center conductor 108.

A female connector 116 is coupled to the central conductor 108 at the first end of the cable connection system 100.

Figure 1B:
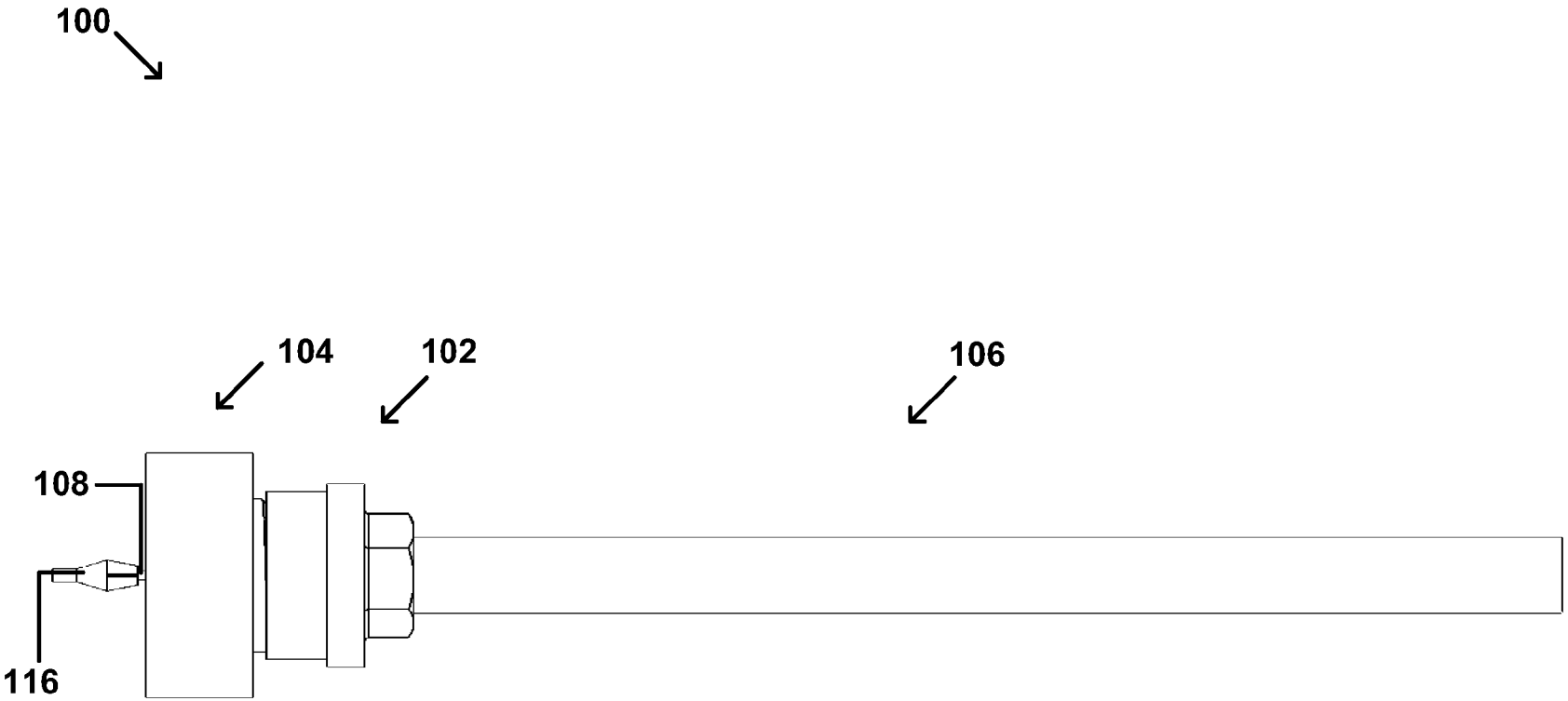
FIG. 1B is a front view of an exemplary cable connection system with a coaxial cable inserted therein.

FIG. 1B is a front view of an exemplary cable connection system 100 with a coaxial cable inserted therein. The cable connection system 100 includes, for example, a nut assembly 102, a slug assembly (not shown), and a port assembly 104. A female connector 116 is coupled to the central conductor 108 at the first end of the cable connection system 100.

Figure 1C:
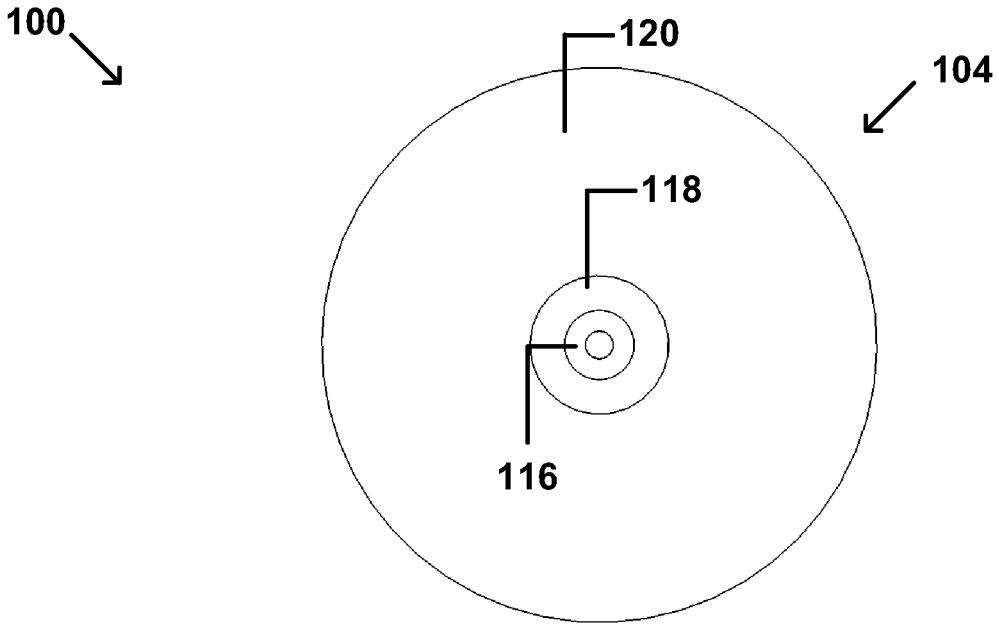
FIG. 1C is a left side view of an exemplary cable connection system.

FIG. 1C is a left side view of an exemplary cable connection system 100 with a coaxial cable inserted therein. The cable connection system 100 includes, for example, a nut assembly (not shown), a slug assembly (not shown), and a port assembly 104. The port assembly 104 includes, for example, a port 120, and an insulator ring 118 inserted into the port assembly 104. A female connector 116 is coupled to the central conductor (not shown).

Figure 1D:
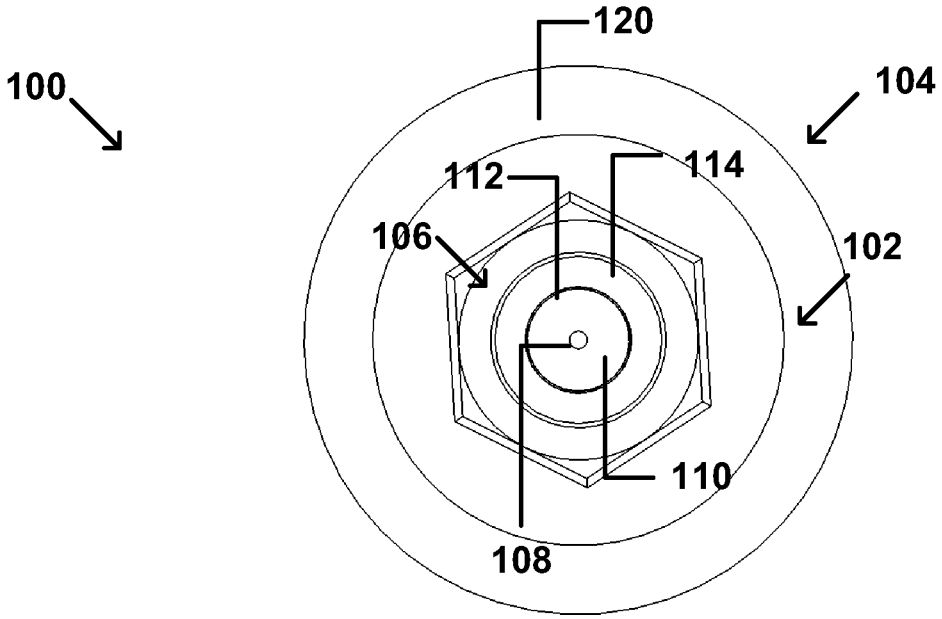
FIG. 1D is a right side view of an exemplary cable connection system with a coaxial cable inserted therein.

FIG. 1D is a right side view of an exemplary cable connection system 100 with a coaxial cable inserted therein. The cable connection system 100 includes, for example, a nut assembly 102, a slug assembly (not shown), and a port assembly 104. The coaxial cable 106, which includes, for example, a central conductor 108, a cable dielectric 110, a laminated shield tape (LST) 112, and an insulated cable jacket 114.

Figure 1E:
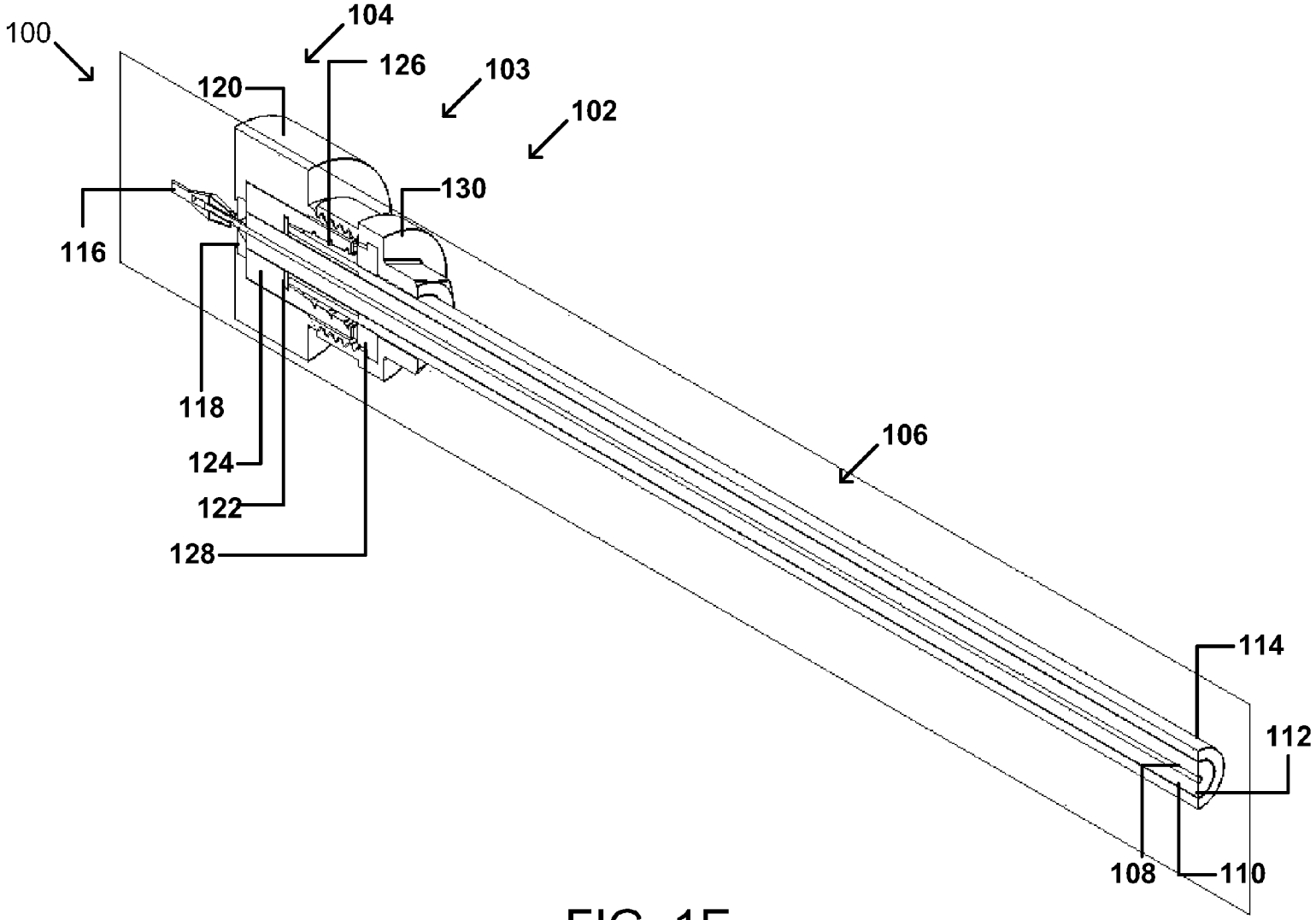
FIG. 1E is a cross-sectional perspective view of an exemplary cable connection system attached to a coaxial cable.

FIG. 1E is a cross-sectional perspective view of an exemplary cable connection system 100 attached to a coaxial cable. The plane of the cross-section is indicated. The cable connection system 100 includes, for example, a nut assembly 102, a slug assembly 103, and a port assembly 104. The nut assembly 102 includes, for example, a donut 128, and a nut 130. The slug assembly 103 includes, for example, a first sleeve 122, a second sleeve 124, and a ferule 126. The port assembly 104 includes, for example, a port 120 and an insulator ring 118.

The coaxial cable 106 includes, for example, a central conductor 108, a cable dielectric 110, a laminated shield tape (LST) 112, and an insulated cable jacket 114.

Figure 2:
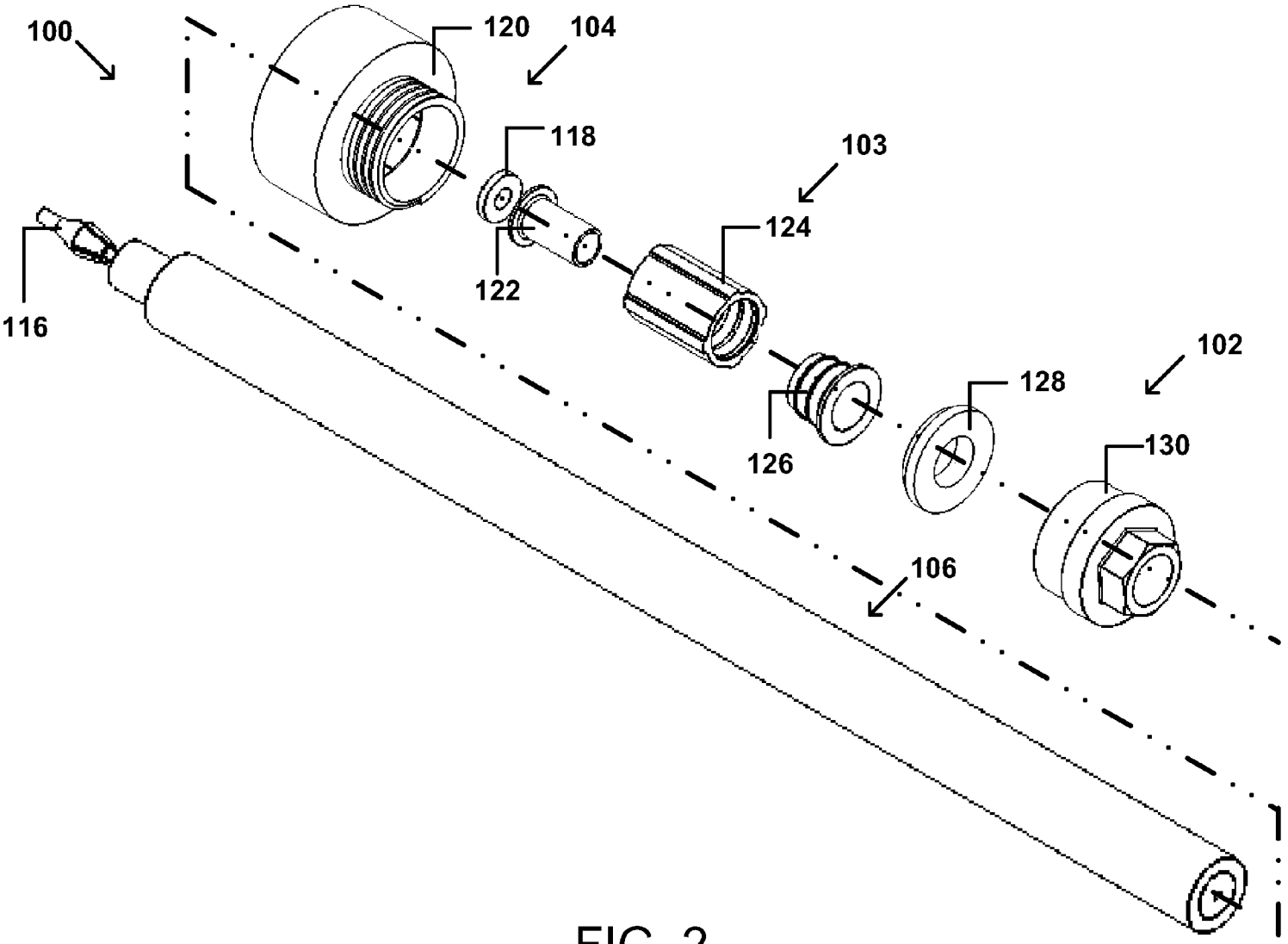
FIG. 2 is an exploded perspective view of an exemplary cable connection system with a coaxial cable inserted therein.

FIG. 2 is an exploded perspective view of an exemplary cable connection system 100 with a coaxial cable inserted therein. The cable connection system 100 includes, for example, a nut assembly 102, a slug assembly 103, and a port assembly 104.

The nut assembly 102 includes, for example, a donut 128, and a nut 130. The slug assembly 103 includes, for example, a first sleeve 122, a second sleeve 124, and a ferule 126. The port assembly 104 includes, for example, a port 120 and an insulator ring 118.

The coaxial cable 106 includes, for example, a central conductor 108, a cable dielectric 110, a laminated shield tape (LST) 112, and an insulated cable jacket 114.

Figure 3A:
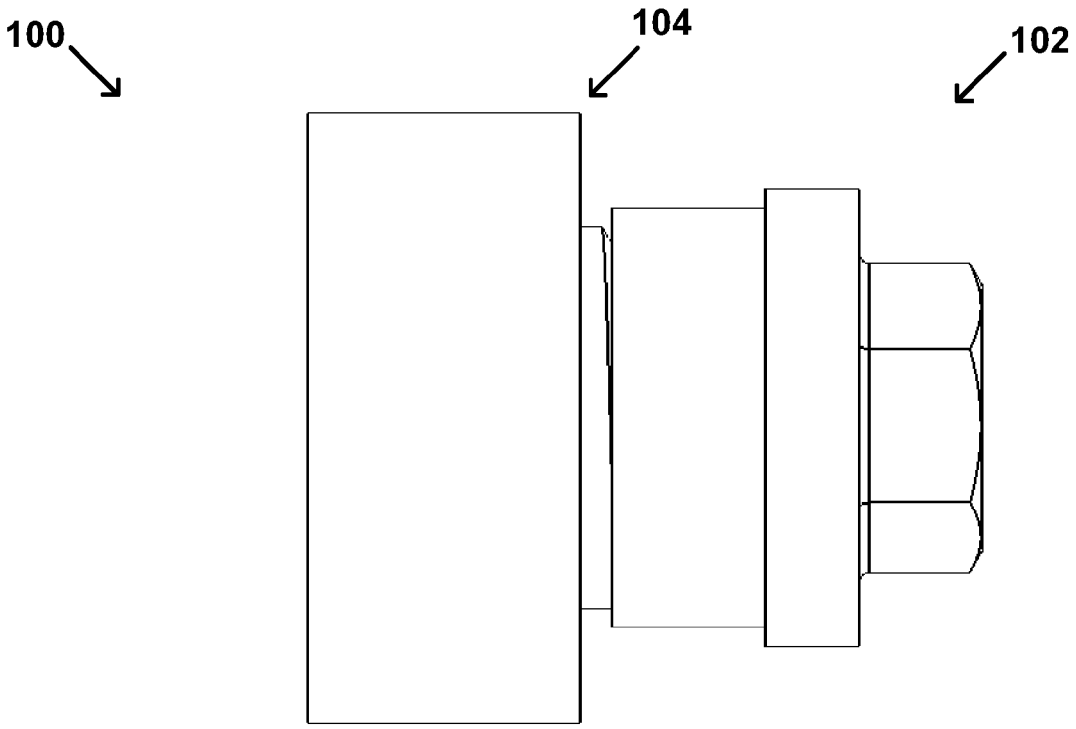
FIG. 3A is a front view of an exemplary cable connection system.

FIG. 3A is a front view of an exemplary cable connection system 100. The cable connection system 100 includes, for example, a nut assembly 102, a slug assembly (not shown), and a port assembly 104.

Figure 3B:
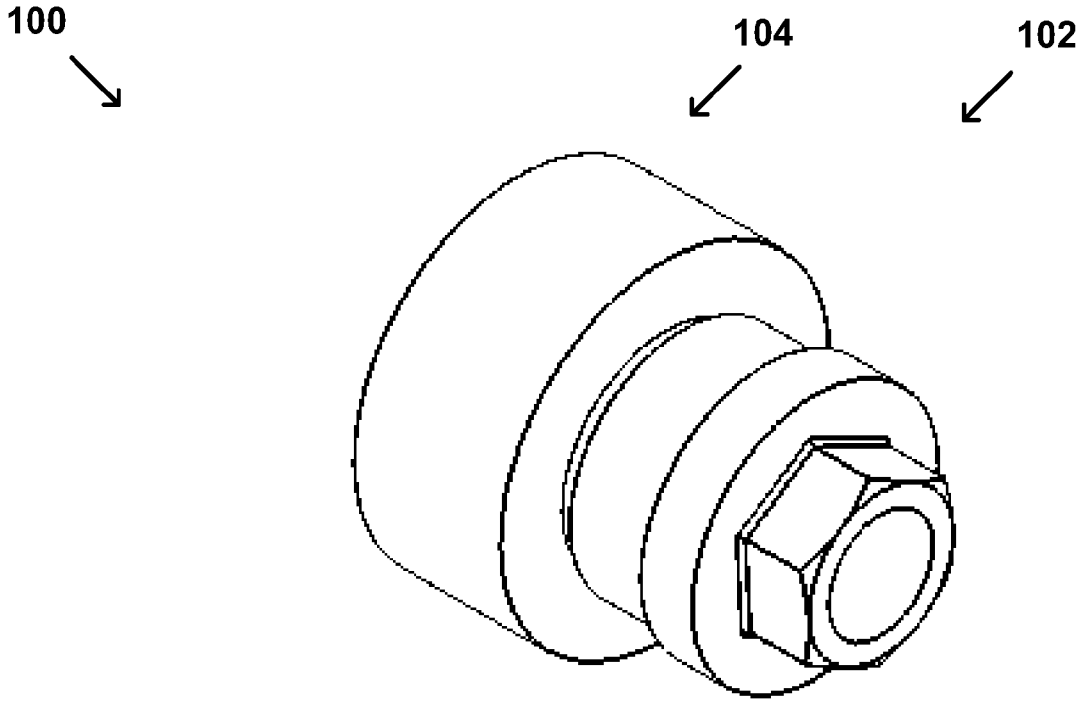
FIG. 3B is a perspective view of an exemplary cable connection system.

FIG. 3B is a perspective view of an exemplary cable connection system 100. The cable connection system 100 includes, for example, a nut assembly 102, the slug assembly (not shown), and a port assembly 104.

Figure 3C:
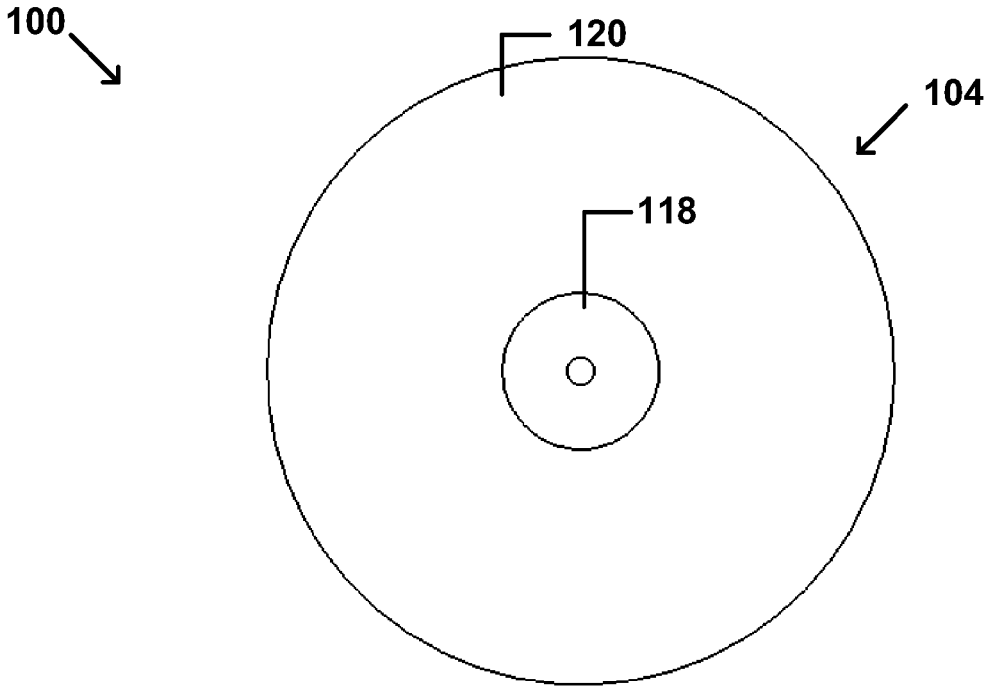
FIG. 3C is a left side view of an exemplary cable connection system.

FIG. 3C is a left side view of an exemplary cable connection system 100. The cable connection system 100 includes, for example, the nut assembly (not shown), the slug assembly (not shown), and a port assembly 104. The port assembly 104 includes, for example, a port 120 and an insulator ring 118.

Figure 3D:
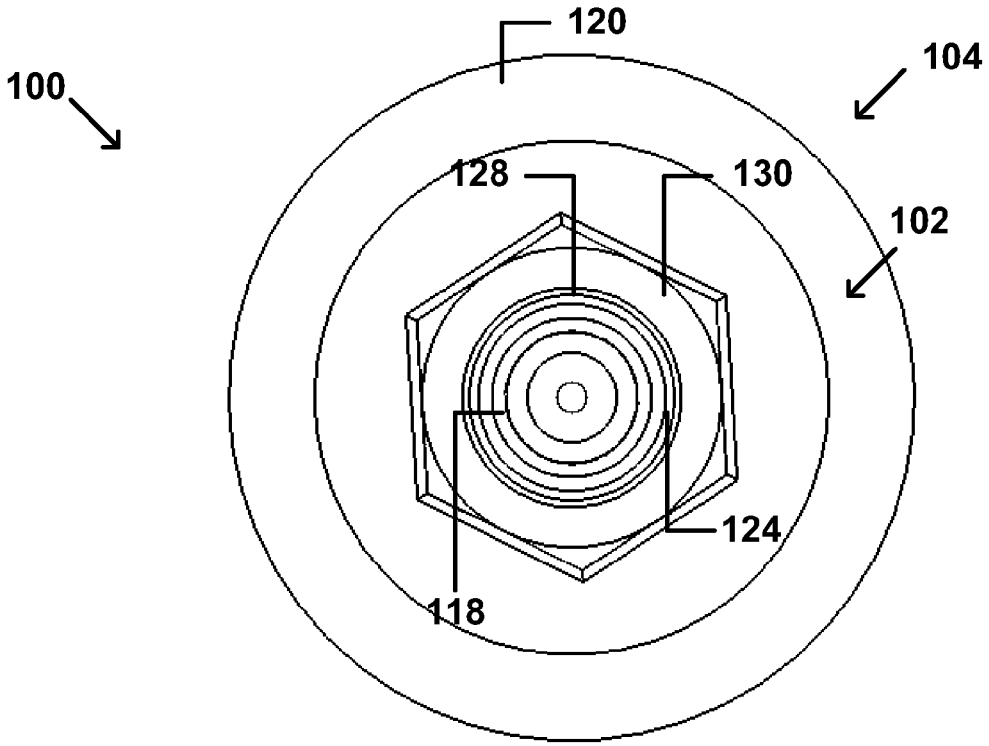
FIG. 3D is a right side view of an exemplary cable connection system.

FIG. 3D is a right side view of an exemplary cable connection system 100. The cable connection system 100 includes, for example, a nut assembly 102, a slug assembly (not shown), and a port assembly 104. In the interior of the cable connection system 100 is shown the insulator ring 118, a second sleeve 124, and a donut 128.

Figure 3E:
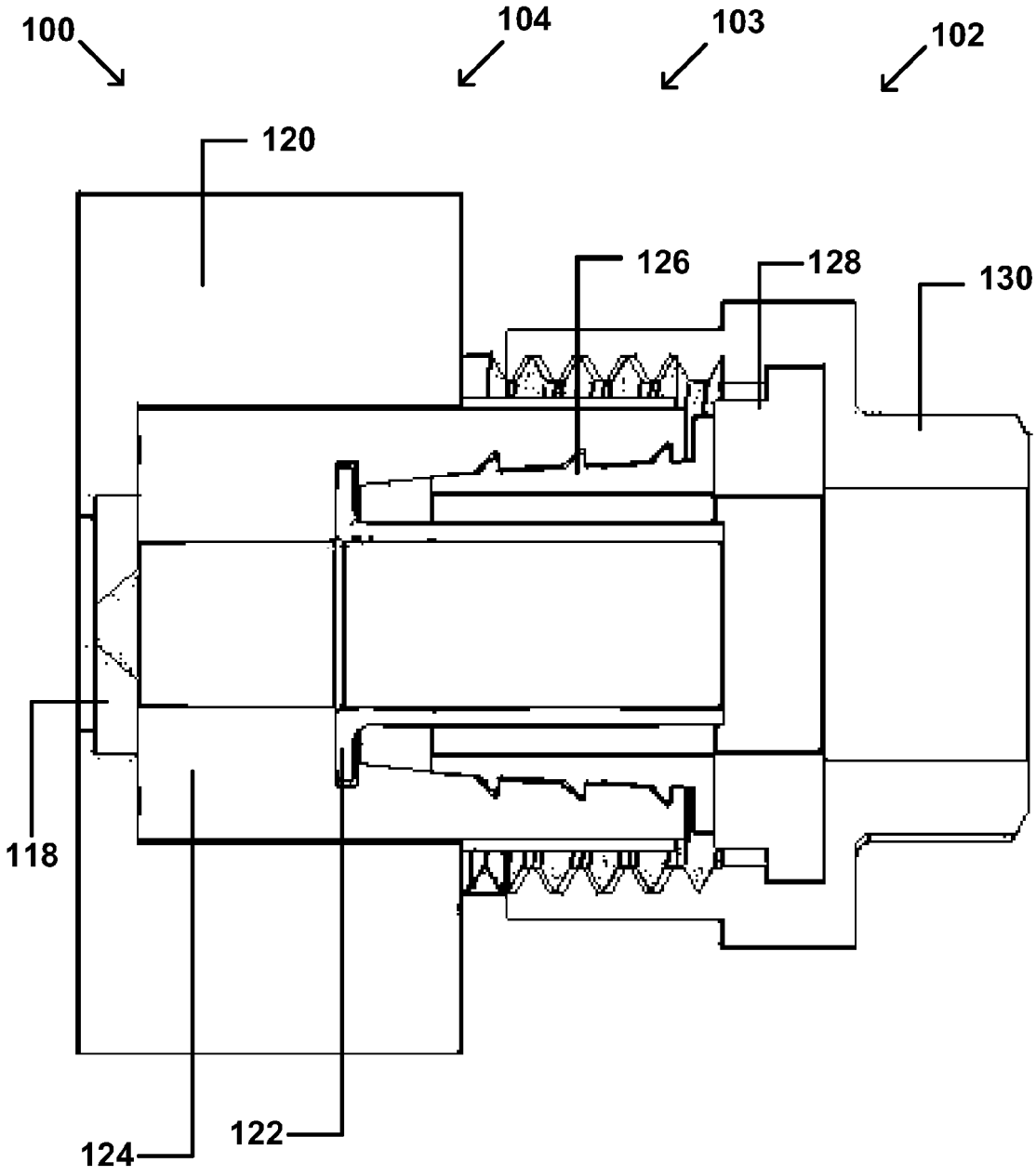
FIGS. 3E and 3F are cross-sectional view and cross-sectional perspective views, respectively, of an exemplary cable connection system.
Figure 3F:
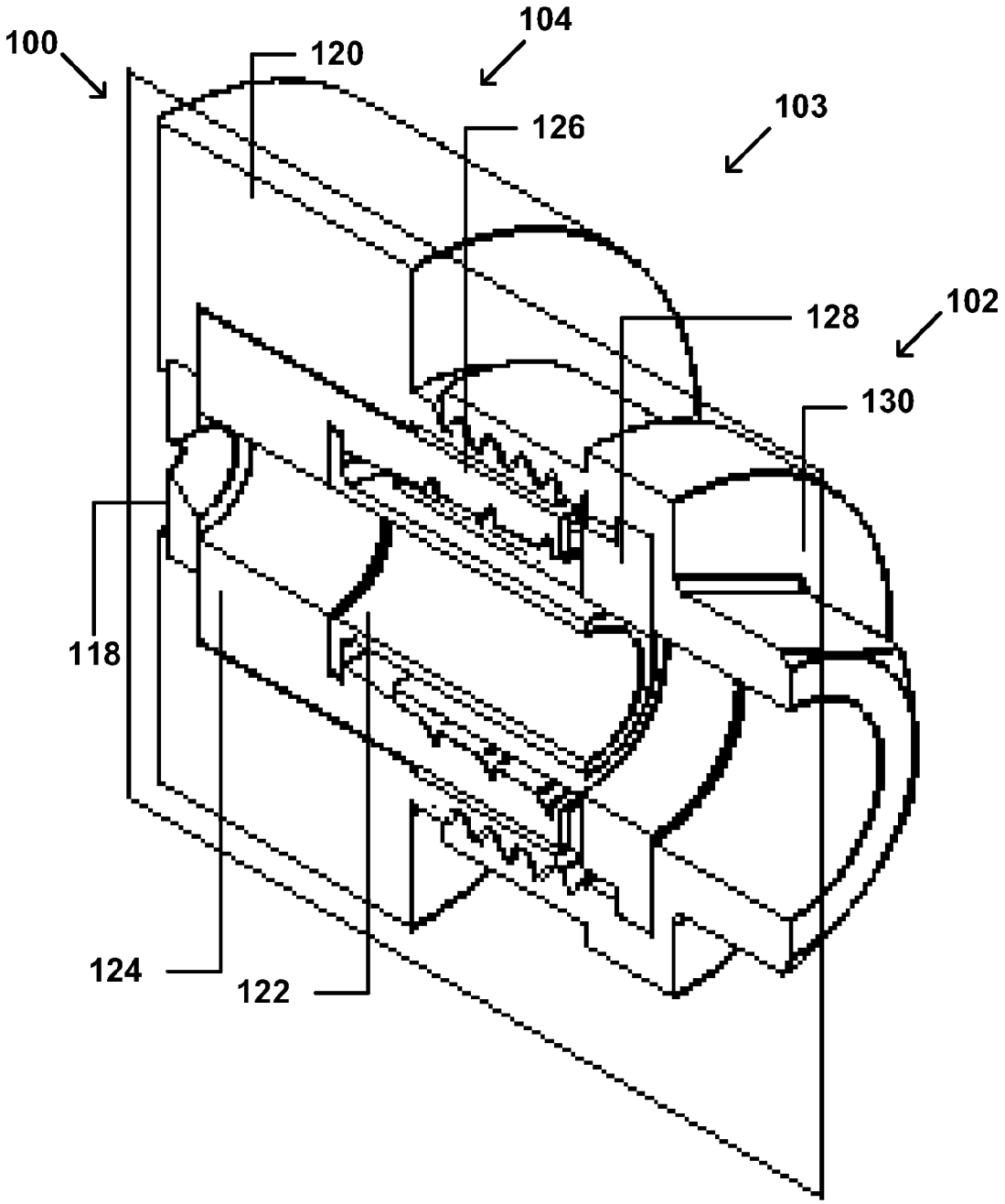
Figure 4A:
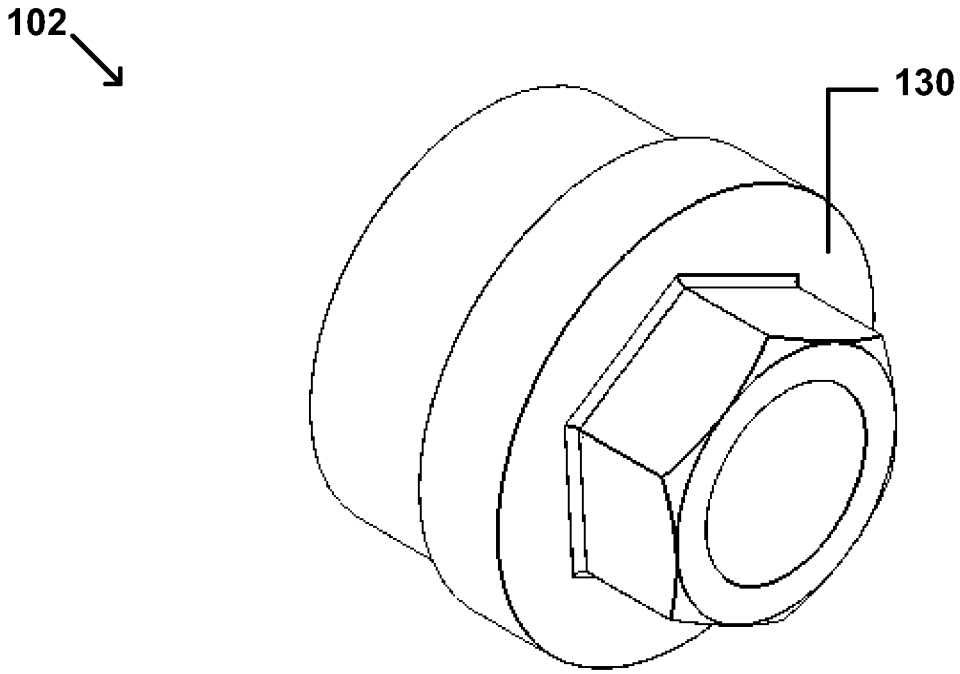
FIGS. 4A-4E are perspective views, right side views, left side views, cross-sectional views, and cross-sectional perspective views, respectively, of an exemplary nut assembly.
Figure 4B:
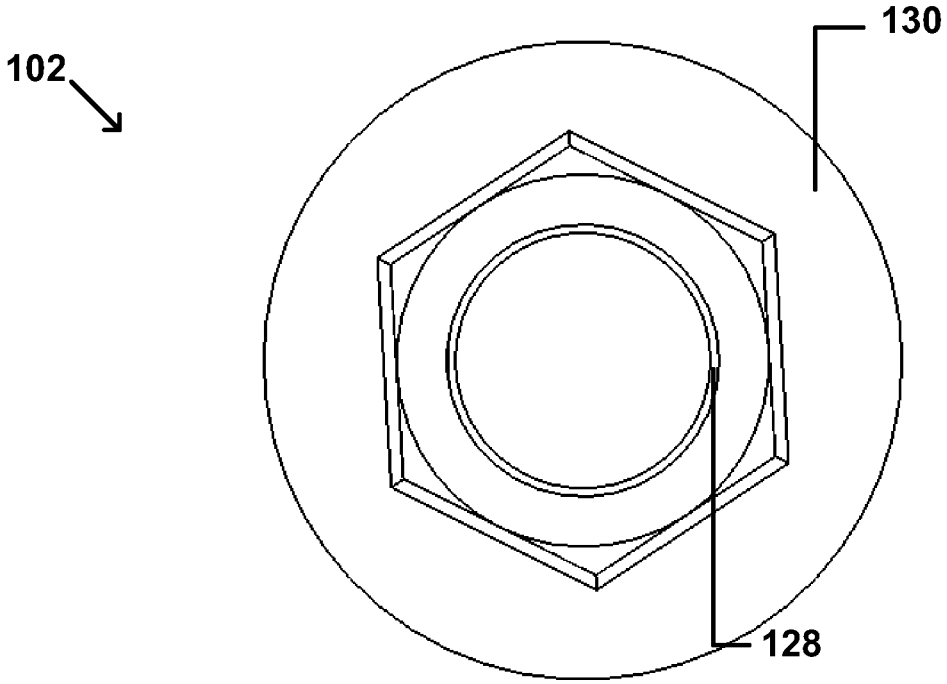
Figure 4C:
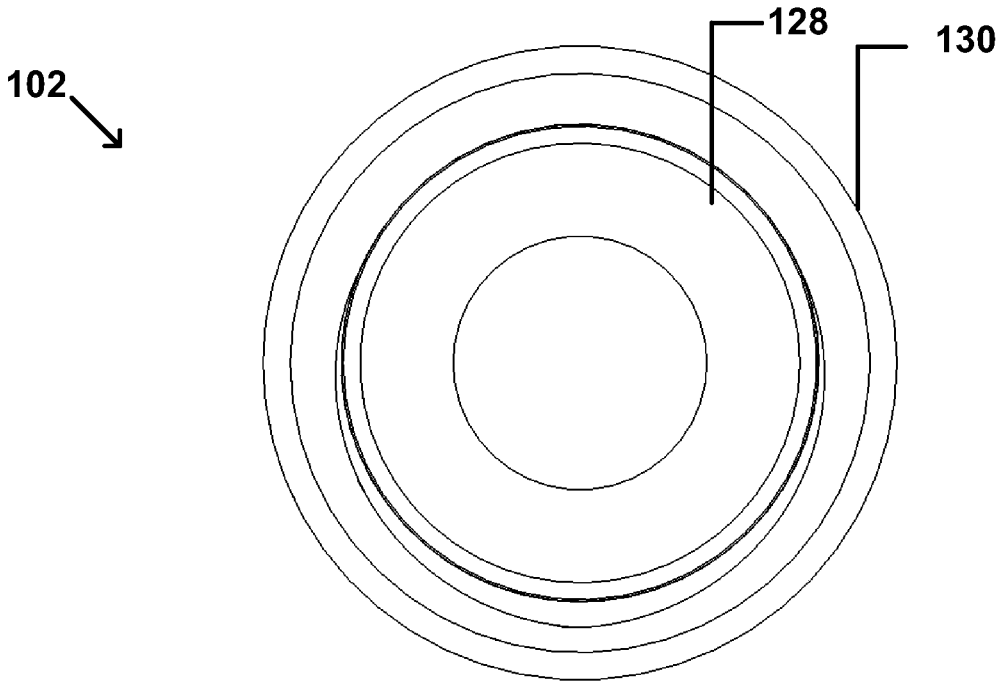
Figure 4D:
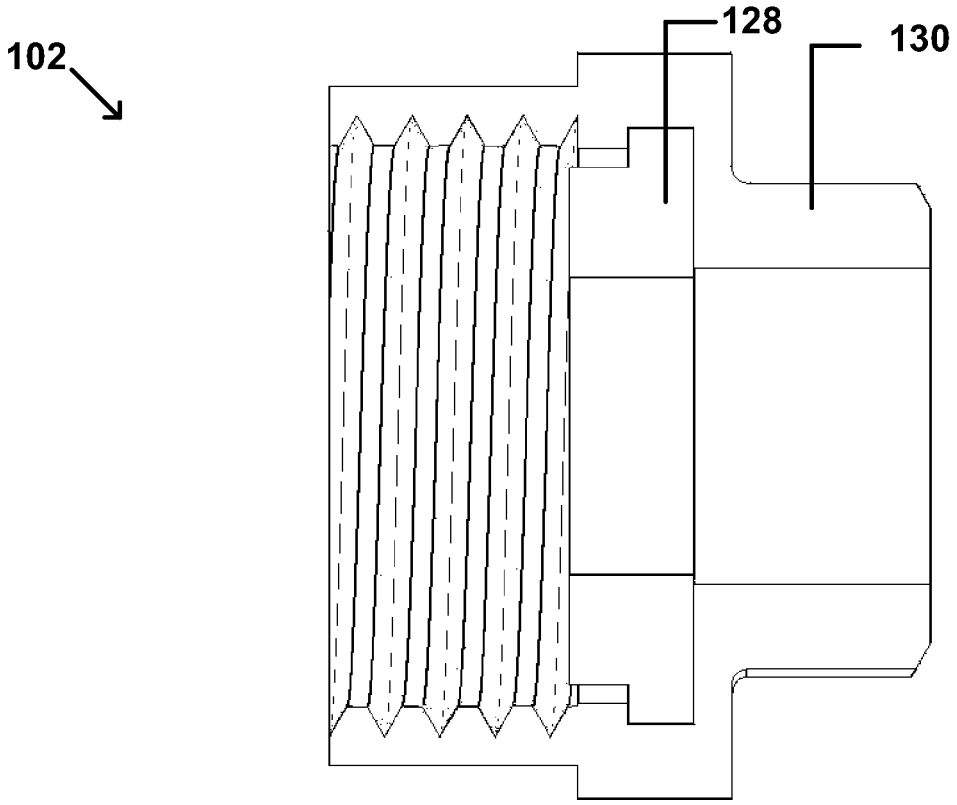
Figure 4E:
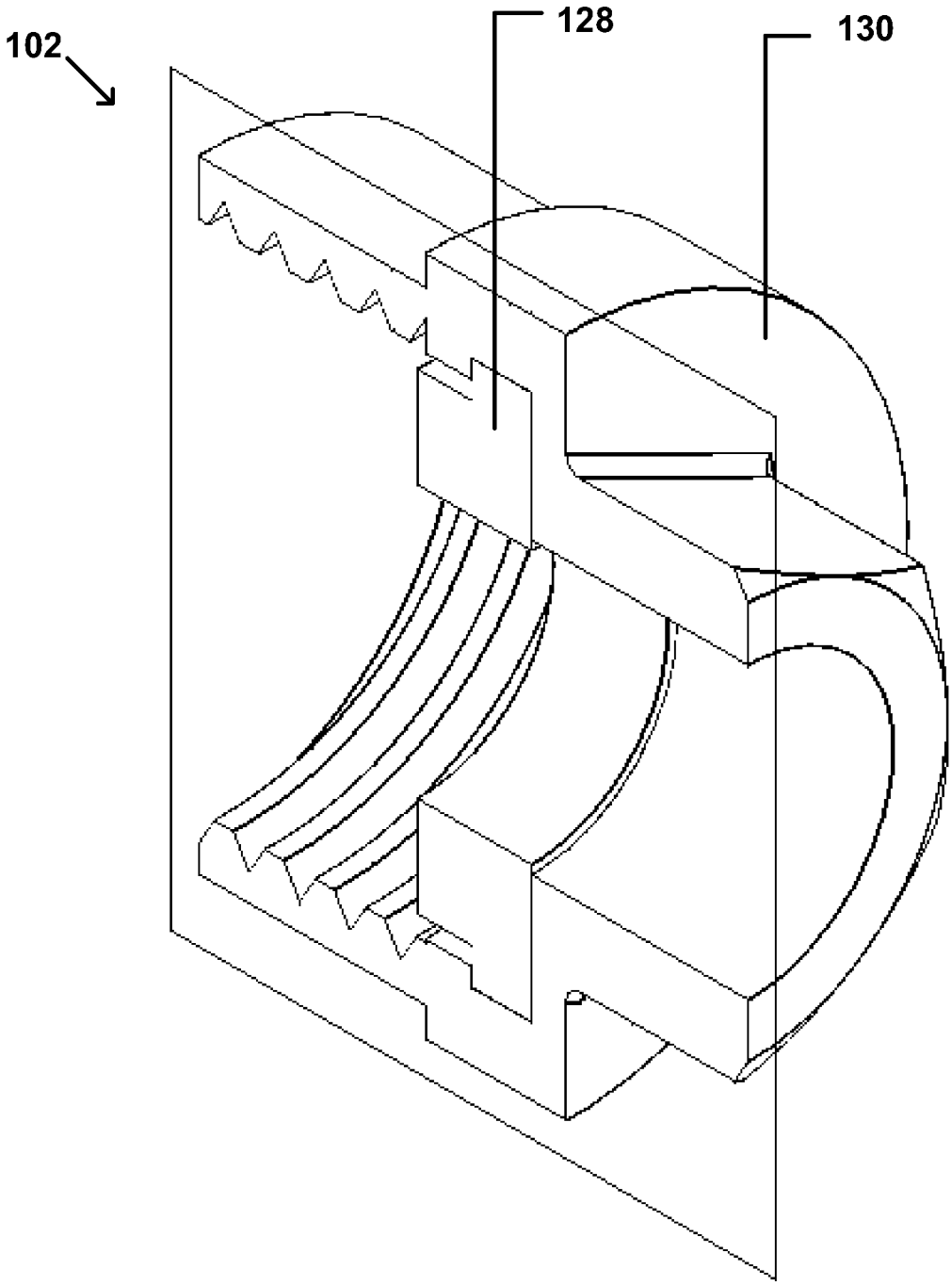
Figure 5A:
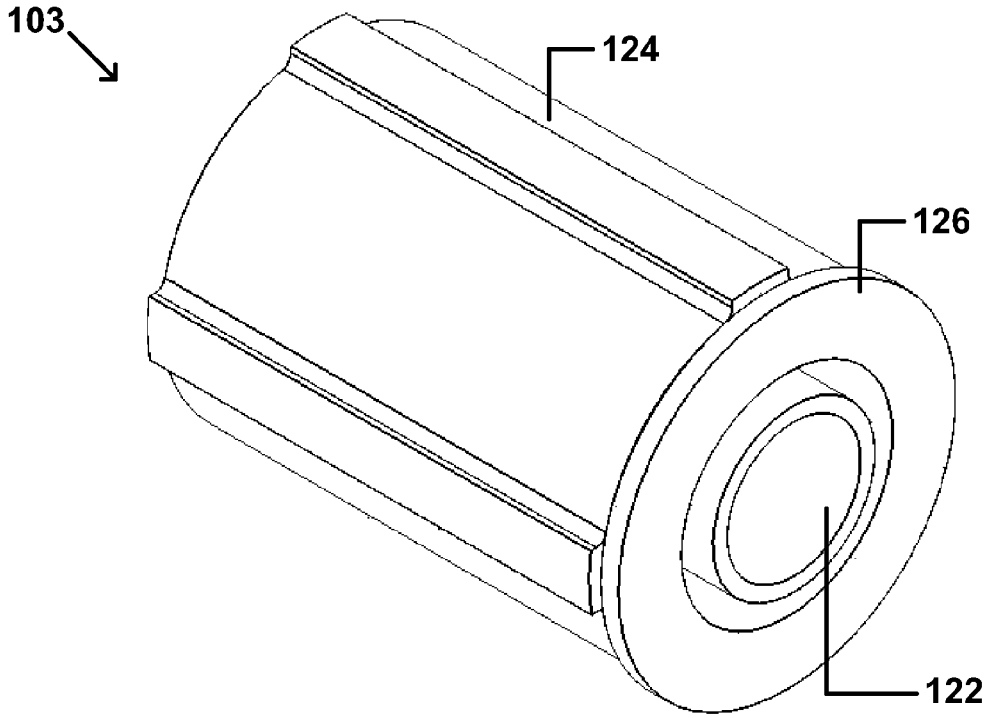
FIGS. 5A-5F are perspective views, front side views, right side views, left side views, cross-sectional views, and cross-sectional perspective views, respectively, of an exemplary slug assembly.
Figure 5B:
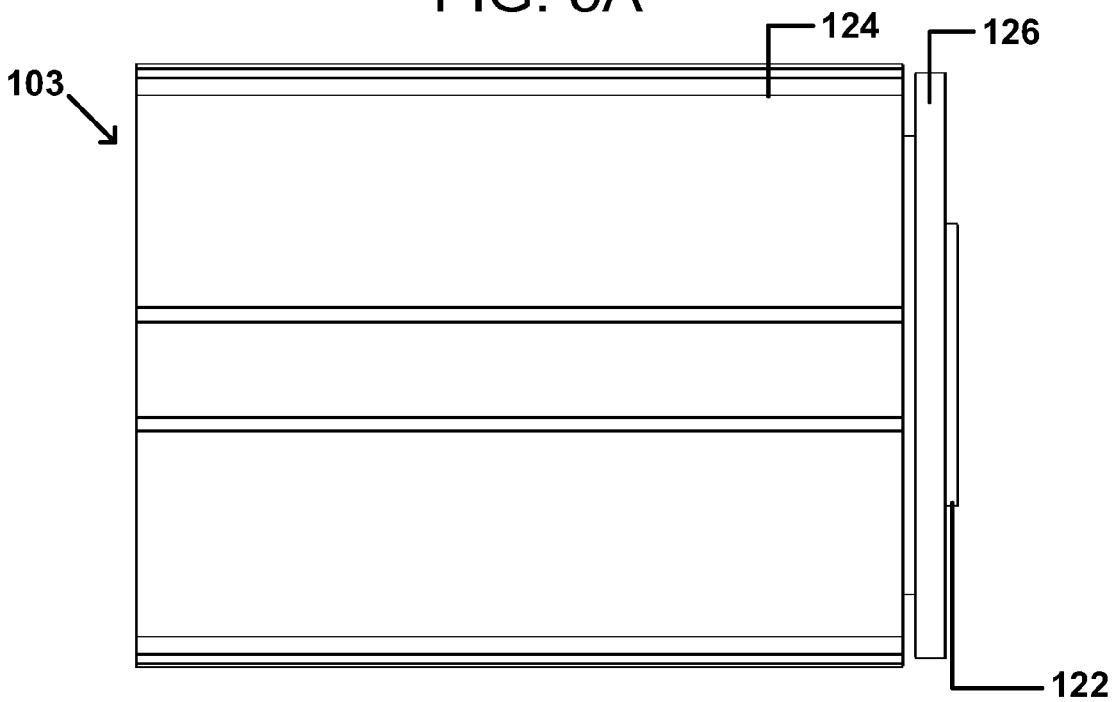
Figure 5C:
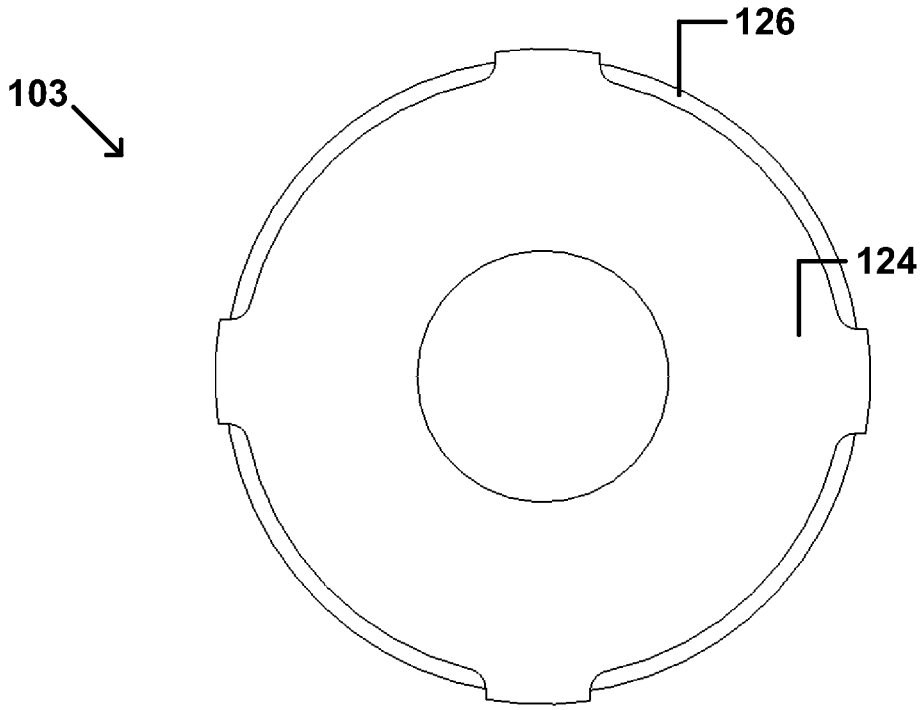
Figure 5D:
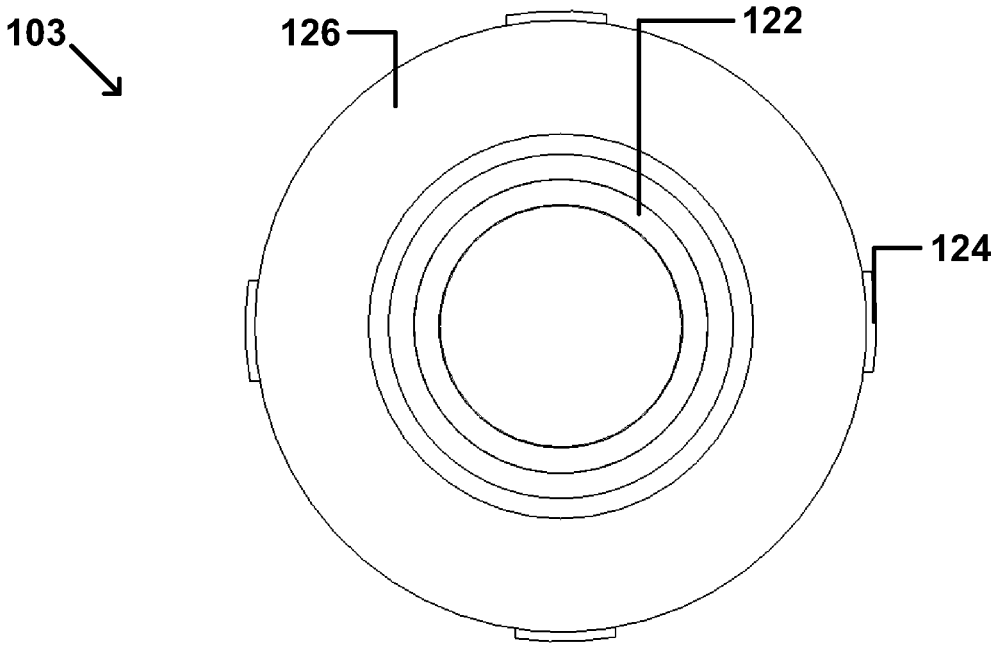
Figure 5E:
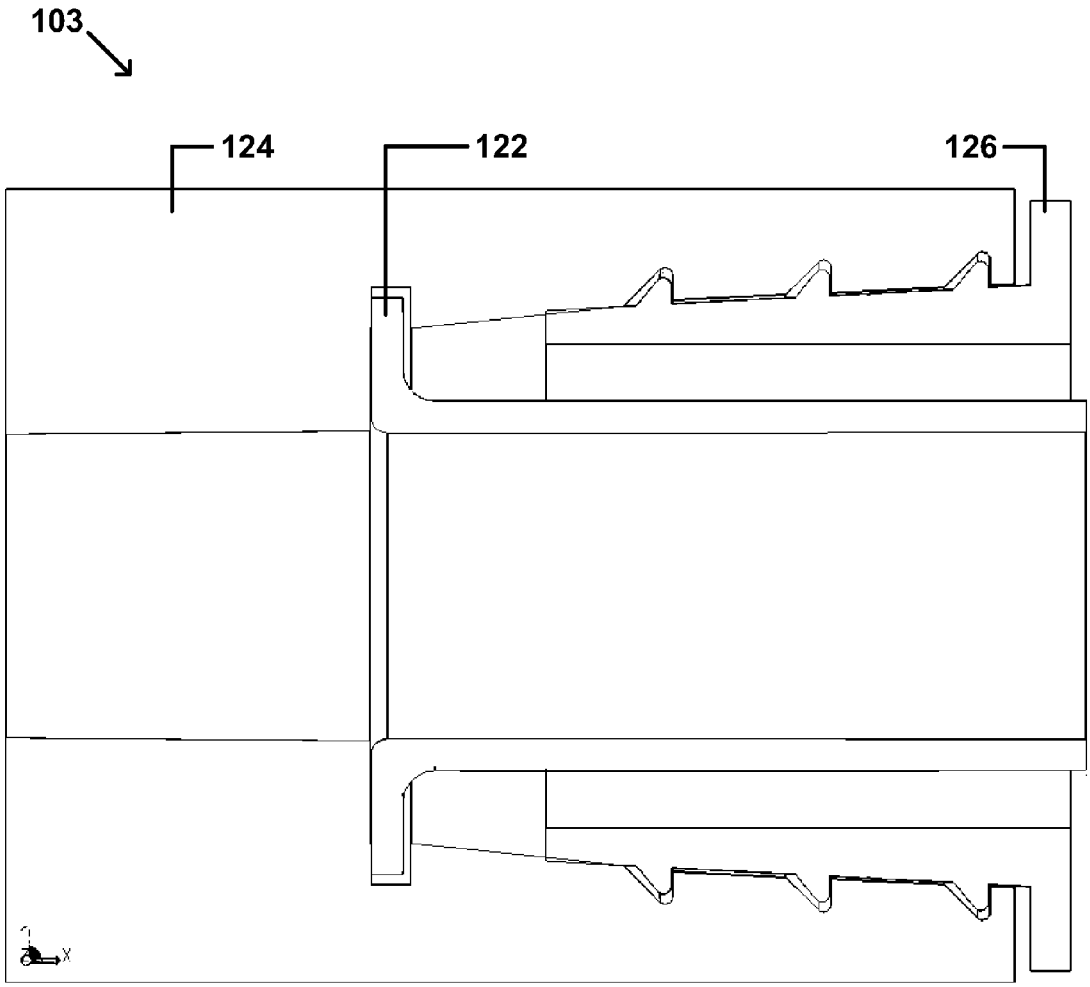
Figure 5F:
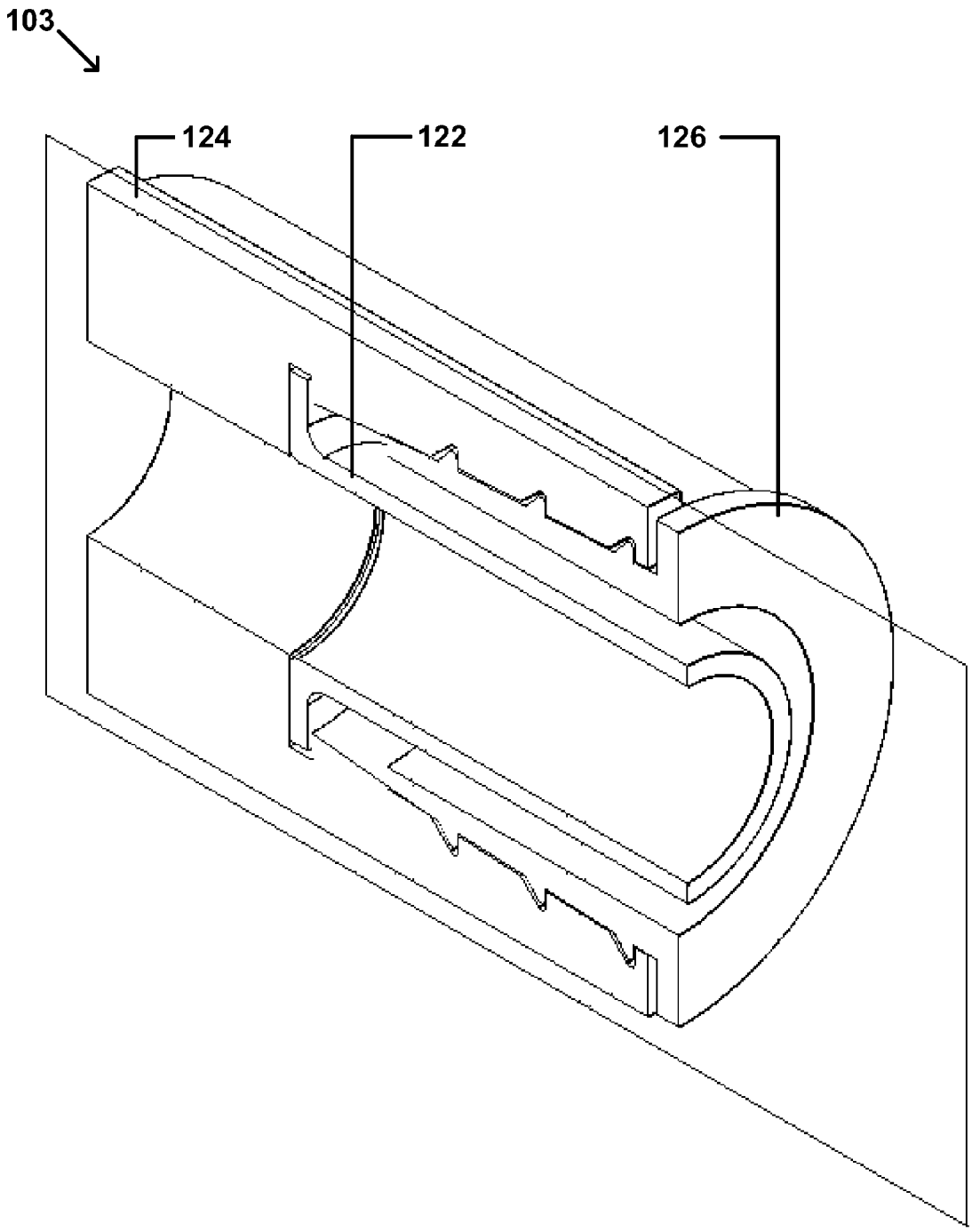
Figure 6A:
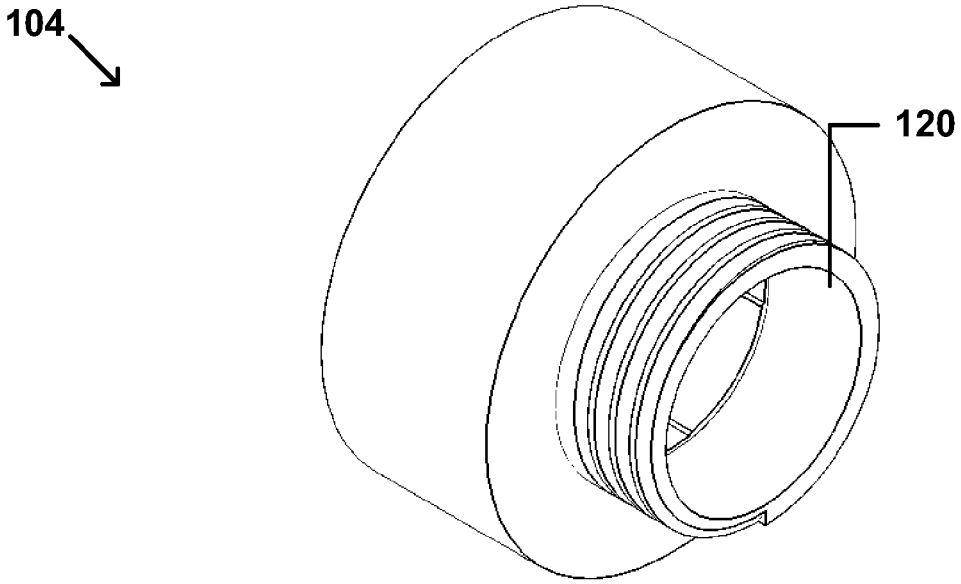
FIGS. 6A-6F are perspective views, front side views, right side views, left side views, cross-sectional views, and cross-sectional perspective views, respectively, of an exemplary port assembly.
Figure 6B:
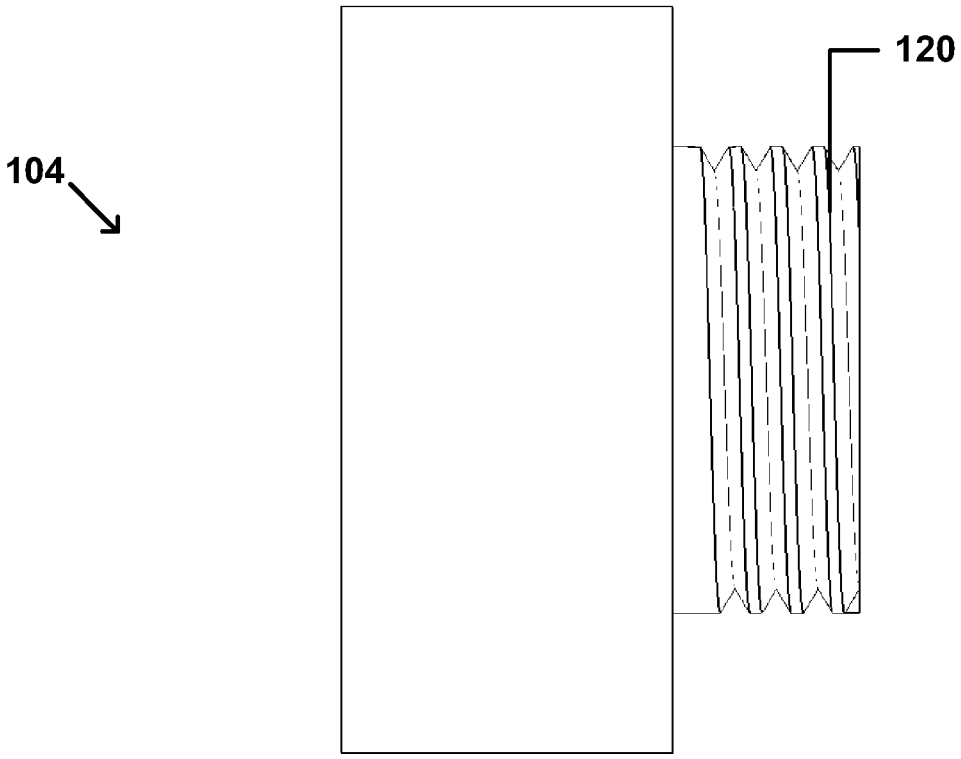
Figure 6C:
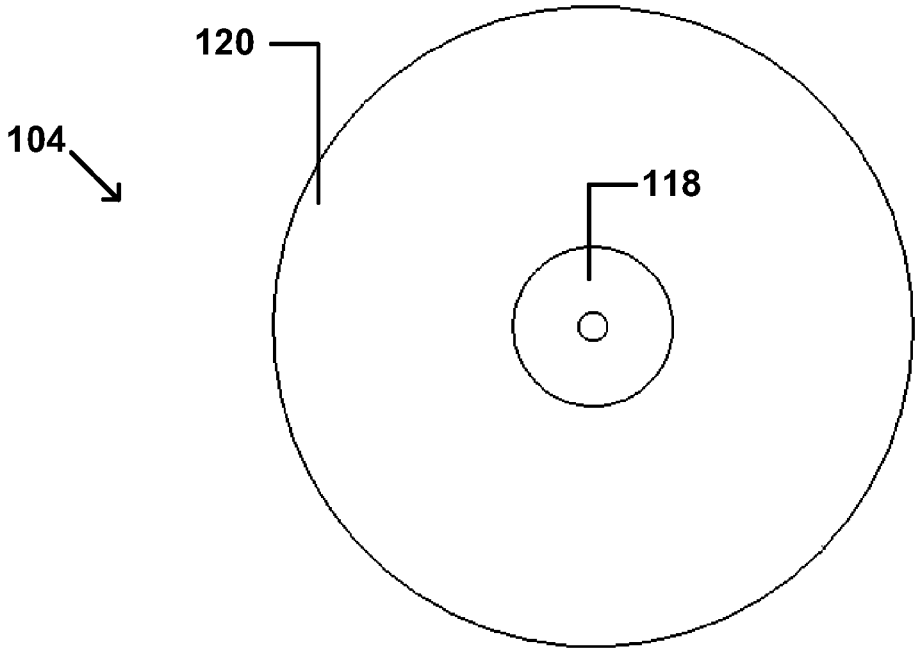
Figure 6D:
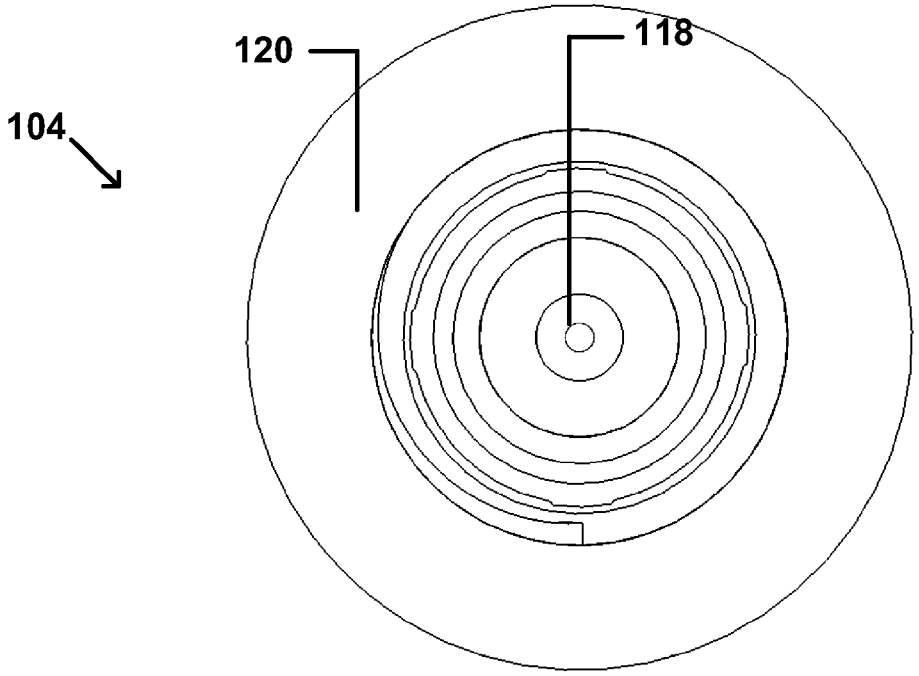
Figure 6E:
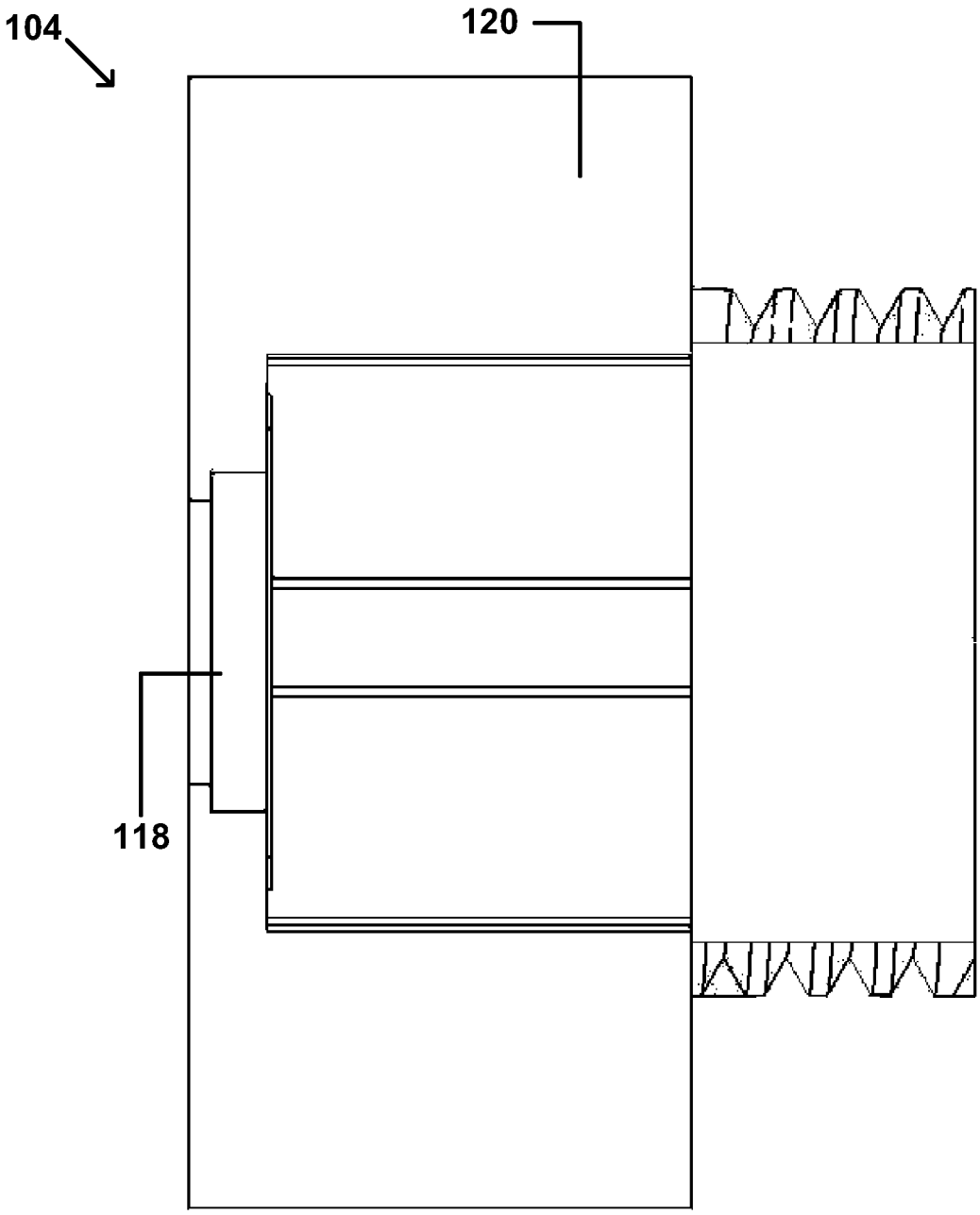
Figure 6F:
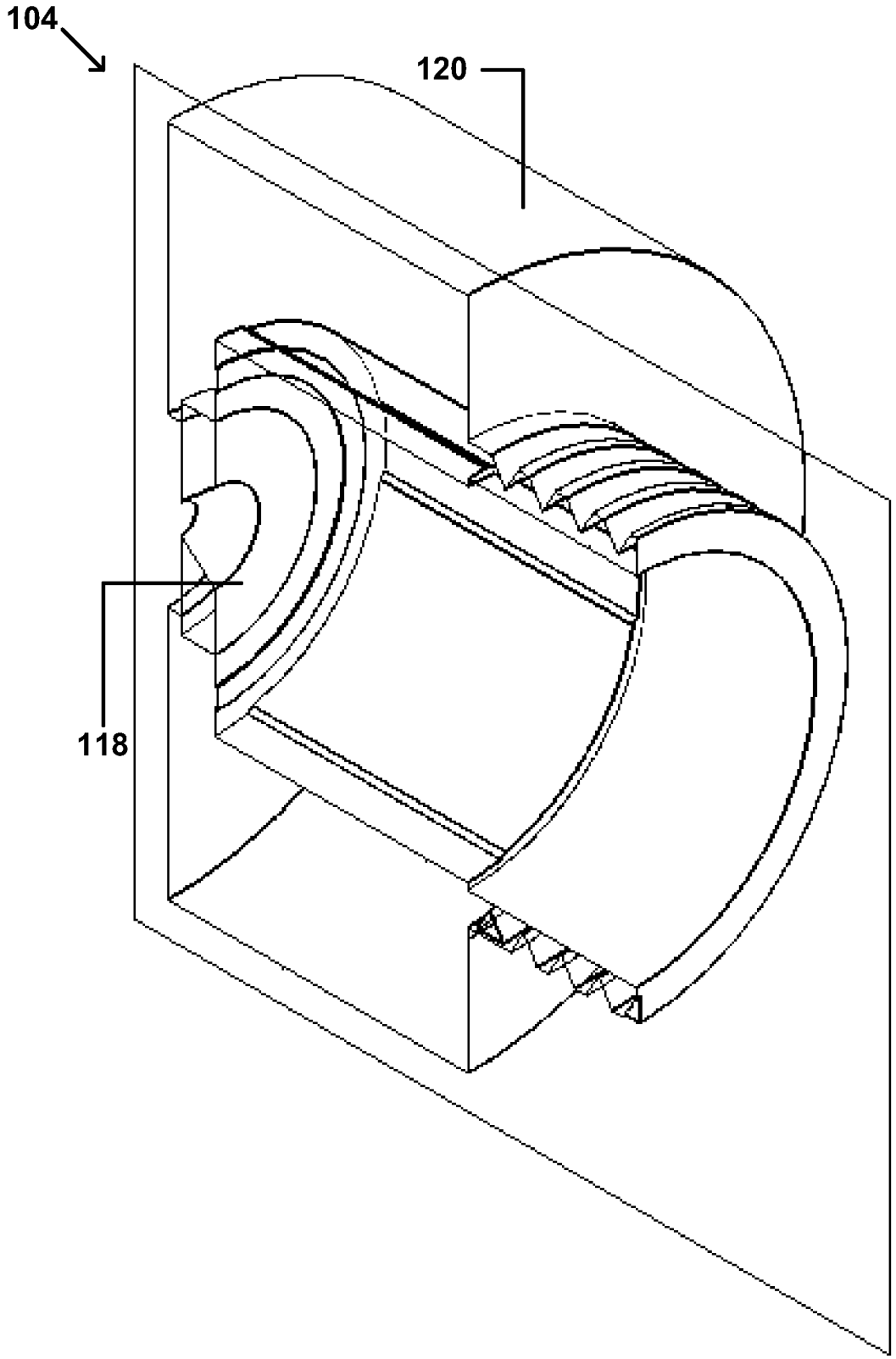

FIGS. 3E and 3F are cross-sectional view and cross-sectional perspective views of an exemplary cable connection system 100, respectively. The plane of the cross-section is indicated. The cable connection system 100 includes, for example, a nut assembly 102, a slug assembly 103, and a port assembly 104.

The nut assembly 102 includes, for example, a donut 128, and a nut 130. The nut 130 has a first end, a second end, one or more exterior surfaces, a first interior surface, a second interior surface, and a third interior surface. The first interior surface of the nut 130 is adjacent the first end and configured with a smooth bore to accept a coaxial cable 106. The second interior surface of the nut 130 is between the first interior surface and the third interior surface. The third interior surface of the nut 130 is adjacent the second end and includes a first thread. The nut 130 includes wrench flats or a knurled outer surface on the one or more exterior surfaces adjacent the first end.

The donut 128 has a first end, a second end, one or more exterior surfaces, and an interior surface. The interior surface of the donut 128 is configured with a smooth bore to accept the coaxial cable. The one or more exterior surfaces of the donut 128 are configured to accept the second interior surface of the nut 130. The donut 128 includes an exterior projection on the one or more exterior surfaces adjacent the first end.

The slug assembly 103 includes, for example, a first sleeve 122, a second sleeve 124, and a ferule 126. The first sleeve 122 has a first end, a second end, one or more exterior surfaces, and an interior surface. The interior surface of the first sleeve 122 is configured with a smooth bore to accept the coaxial cable. The first sleeve 122 includes an exterior projection on the one or more exterior surfaces adjacent the second end.

The second sleeve 124 has a first end, a second end, one or more exterior surfaces, a first interior surface, a second interior surface, and a third interior surface. The first interior surface of the second sleeve 124 is adjacent the first end. The second interior surface of the second sleeve 124 is between the first interior surface and the third interior surface. The second interior surface of the second sleeve 124 is configured to accept the exterior projection of the first sleeve 122. The third interior surface of the second sleeve 124 is adjacent the second end and configured with a smooth bore to accept the coaxial cable. The one or more external projections on the one or more exterior surfaces of the second sleeve 124 include four external projections each independently projecting from each other at an angle of ninety degrees.

The ferrule 126 has a first end, a second end, one or more exterior surfaces, and an interior surface. The ferrule 126 includes an exterior projection on the one or more exterior surfaces adjacent the first end. The interior surface of the ferrule 126 is configured to accept the one or more exterior surfaces of the first sleeve 122. The one or more exterior surfaces of the ferrule 126 are configured with a smooth bore to accept the first interior surface of the second sleeve 124.

The port assembly 104 includes, for example, a port 120 and an insulator ring 118. The port 120 has a first end, a second end, one or more exterior surfaces, a first interior surface, a second interior surface, a third interior surface, and a fourth interior surface. The one or more exterior surfaces adjacent the first end of the port 120 include a second thread configured to accept the first thread of the nut 130. The first interior surface of the port 120 is adjacent the first end and configured to accept the one or more exterior surfaces of the second sleeve 124. The second interior surface of the port 120 is between the first interior surface and the third interior surface adjacent the second end. The third interior surface of the port 120 is between the second interior surface and the fourth interior surface adjacent the second end. The fourth interior surface of the port 120 is adjacent the second end of the port 120. The second interior surface of the port 120 is configured to accept the one or more external projections of the second sleeve 124. The second interior surface of the port 120 includes one or more indentations each independently at an angle of ninety degrees from each other and configured to accept the one or more external projections of the second sleeve 124.

The insulative ring 118 has a first end, a second end, one or more exterior surfaces, and an interior surface. The one or more exterior surfaces of the insulative ring 118 are configured with a smooth bore to accept the second interior surface of the port 120. The interior surface of the insulative ring 118 is tapered to allow for the protrusion of a central conductor electrode in the coaxial cable from the second end of the insulative ring 118 through the third interior surface of the port 120 and the second end of the port 120. The first interior surface of the second sleeve 124 includes a third thread configured to accept a fourth thread on the one or more exterior surfaces of the ferrule 126.

FIGS. 4A, 4B, 4C, 4D, and 4E are perspective views, right side views, left side views, cross-sectional views, and cross-sectional perspective views, respectively, of an exemplary nut assembly 102. The plane of the cross-section is indicated. The nut assembly 102 includes, for example, a donut 128, and a nut 130.

The nut 130 has a first end, a second end, one or more exterior surfaces, a first interior surface, a second interior surface, and a third interior surface. The first interior surface of the nut 130 is adjacent the first end and configured with a smooth bore to accept a coaxial cable 106. The second interior surface of the nut 130 is between the first interior surface and the third interior surface. The third interior surface of the nut 130 is adjacent the second end and includes a first thread. The nut 130 includes wrench flats or a knurled outer surface on the one or more exterior surfaces adjacent the first end.

The donut 128 has a first end, a second end, one or more exterior surfaces, and an interior surface. The interior surface of the donut 128 is configured with a smooth bore to accept the coaxial cable. The one or more exterior surfaces of the donut 128 are configured to accept the second interior surface of the nut 130. The donut 128 includes an exterior projection on the one or more exterior surfaces adjacent the first end.

FIGS. 5A, 5B, 5C, 5D, 5E, and 5F are perspective views, front side views, right side views, left side views, cross-sectional views, and cross-sectional perspective views, respectively, of an exemplary slug assembly 103. The plane of the cross-section is indicated. The slug assembly 103 includes, for example, a first sleeve 122, a second sleeve 124, and a ferrule 126.

The first sleeve 122 has a first end, a second end, one or more exterior surfaces, and an interior surface. The interior surface of the first sleeve 122 is configured with a smooth bore to accept the coaxial cable. The first sleeve 122 includes an exterior projection on the one or more exterior surfaces adjacent the second end.

The second sleeve 124 has a first end, a second end, one or more exterior surfaces, a first interior surface, a second interior surface, and a third interior surface. The first interior surface of the second sleeve 124 is adjacent the first end. The second interior surface of the second sleeve 124 is between the first interior surface and the third interior surface. The second interior surface of the second sleeve 124 is configured to accept the exterior projection of the first sleeve 122. The third interior surface of the second sleeve 124 is adjacent the second end and configured with a smooth bore to accept the coaxial cable. The one or more external projections on the one or more exterior surfaces of the second sleeve 124 include four external projections each independently projecting from each other at an angle of ninety degrees.

The ferrule 126 has a first end, a second end, one or more exterior surfaces, and an interior surface. The ferrule 126 includes an exterior projection on the one or more exterior surfaces adjacent the first end. The interior surface of the ferrule 126 is configured to accept the one or more exterior surfaces of the first sleeve 122. The one or more exterior surfaces of the ferrule 126 are configured with a smooth bore to accept the first interior surface of the second sleeve 124.

FIGS. 6A, 6B, 6C, 6D, 6E, and 6F are perspective views, front side views, left side views, right side views, cross-sectional views, and cross-sectional perspective views, respectively, of an exemplary port assembly 104. The plane of the cross-section is indicated. The port assembly 104 includes, for example, a port 120 and an insulator ring 118.

The port 120 has a first end, a second end, one or more exterior surfaces, a first interior surface, a second interior surface, a third interior surface, and a fourth interior surface. The one or more exterior surfaces adjacent the first end of the port 120 include a second thread configured to accept the first thread of the nut 130. The first interior surface of the port 120 is adjacent the first end and configured to accept the one or more exterior surfaces of the second sleeve 124. The second interior surface of the port 120 is between the first interior surface and the third interior surface adjacent the second end. The third interior surface of the port 120 is between the second interior surface and the fourth interior surface adjacent the second end. The fourth interior surface of the port 120 is adjacent the second end of the port 120. The second interior surface of the port 120 is configured to accept the one or more external projections of the second sleeve 124. The second interior surface of the port 120 includes one or more indentations each independently at an angle of ninety degrees from each other and configured to accept the one or more external projections of the second sleeve 124.

The insulative ring 118 has a first end, a second end, one or more exterior surfaces, and an interior surface. The one or more exterior surfaces of the insulative ring 118 are configured with a smooth bore to accept the second interior surface of the port 120. The interior surface of the insulative ring 118 is tapered to allow for the protrusion of a central conductor electrode in the coaxial cable from the second end of the insulative ring 118 through the third interior surface of the port 120 and the second end of the port 120. The first interior surface of the second sleeve 124 includes a third thread configured to accept a fourth thread on the one or more exterior surfaces of the ferrule 126.

Figure 7A:
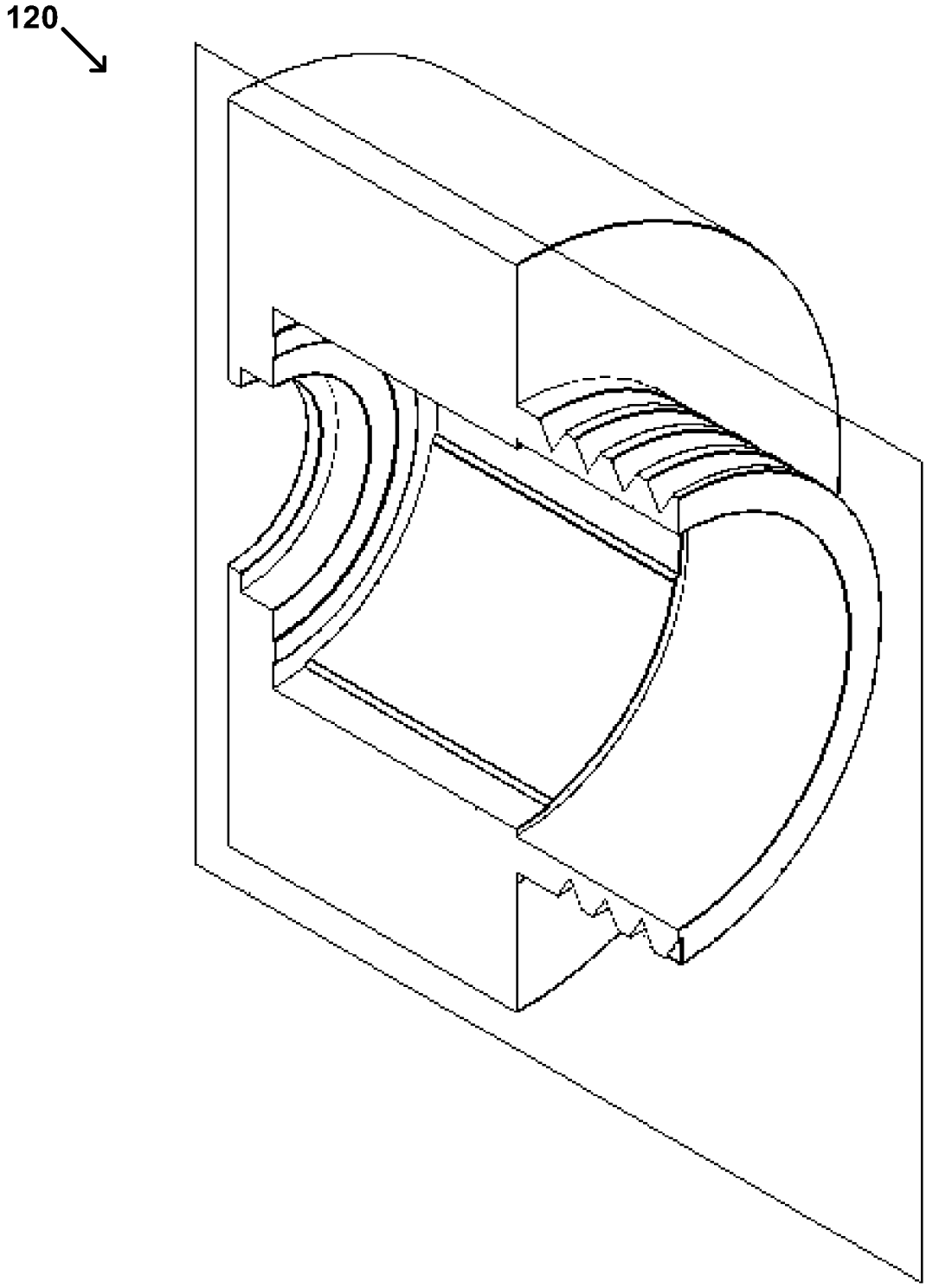
FIG. 7A is a cross-sectional perspective view of an exemplary port.

FIG. 7A is a cross-sectional perspective view of an exemplary port 120. The port 120 has a first end, a second end, one or more exterior surfaces, a first interior surface, a second interior surface, a third interior surface, and a fourth interior surface. The one or more exterior surfaces adjacent the first end of the port 120 include a second thread configured to accept the first thread of the nut 130. The first interior surface of the port 120 is adjacent the first end and configured to accept the one or more exterior surfaces of the second sleeve 124. The second interior surface of the port 120 is between the first interior surface and the third interior surface adjacent the second end. The third interior surface of the port 120 is between the second interior surface and the fourth interior surface adjacent the second end. The fourth interior surface of the port 120 is adjacent the second end of the port 120. The second interior surface of the port 120 is configured to accept the one or more external projections of the second sleeve 124. The second interior surface of the port 120 includes one or more indentations each independently at an angle of ninety degrees from each other and configured to accept the one or more external projections of the second sleeve 124.

Figure 7B:
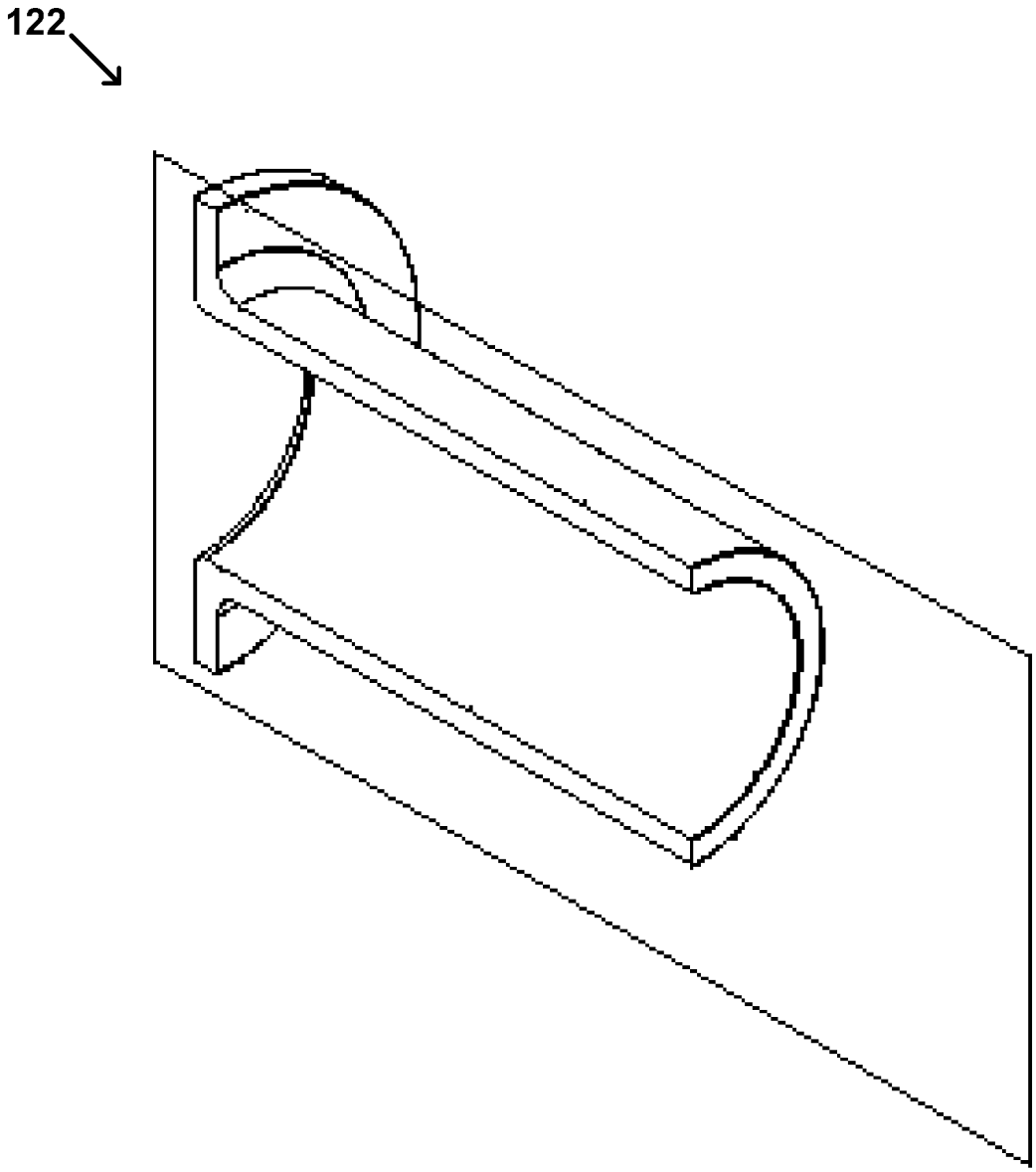
FIG. 7B is a cross-sectional perspective view of an exemplary first sleeve.

FIG. 7B is a cross-sectional perspective view of an exemplary first sleeve 122. The first sleeve 122 has a first end, a second end, one or more exterior surfaces, and an interior surface. The interior surface of the first sleeve 122 is configured with a smooth bore to accept the coaxial cable. The first sleeve 122 includes an exterior projection on the one or more exterior surfaces adjacent the second end.

Figure 7C:
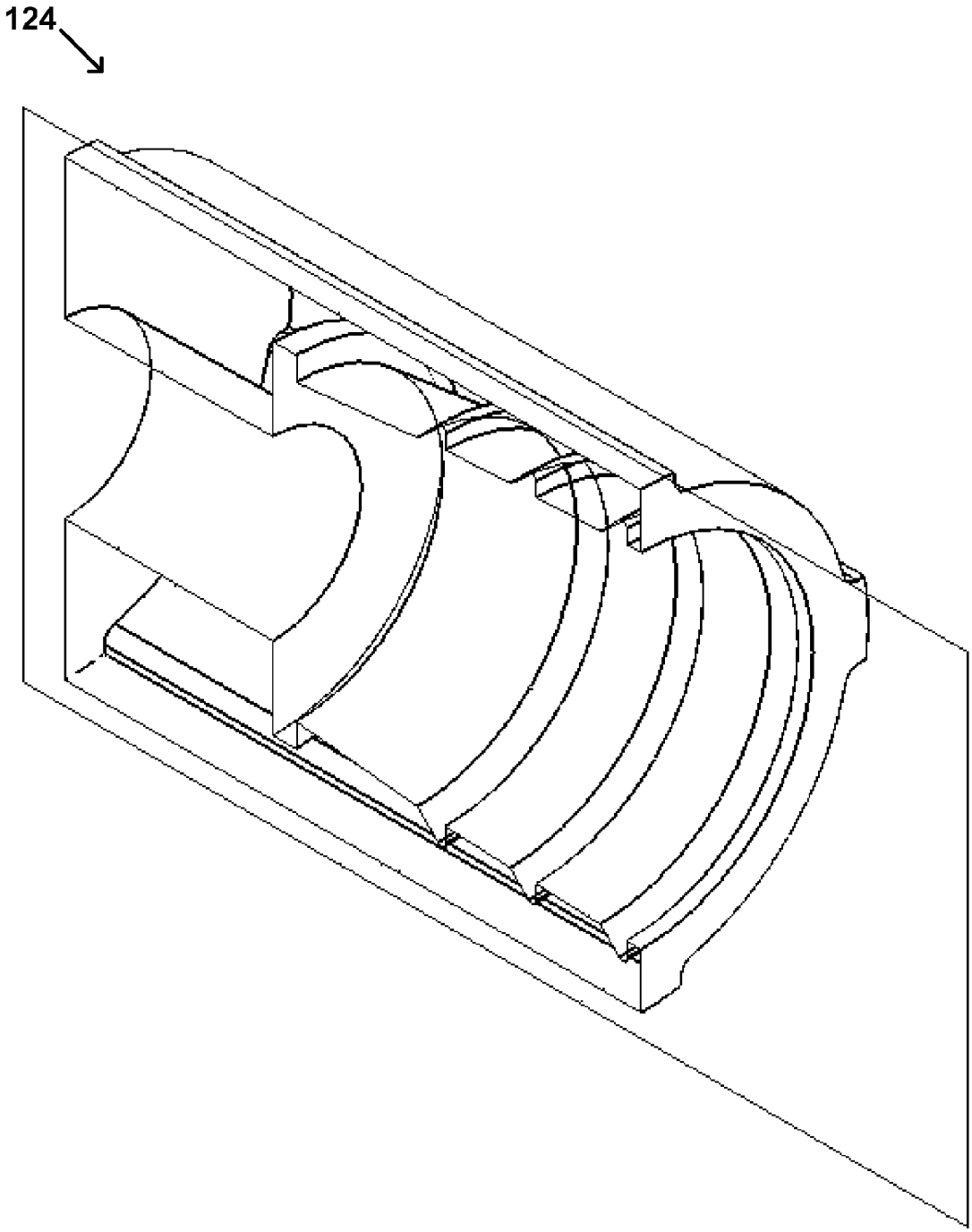
FIG. 7C is a cross-sectional perspective view of an exemplary second sleeve.
Figure 7D:
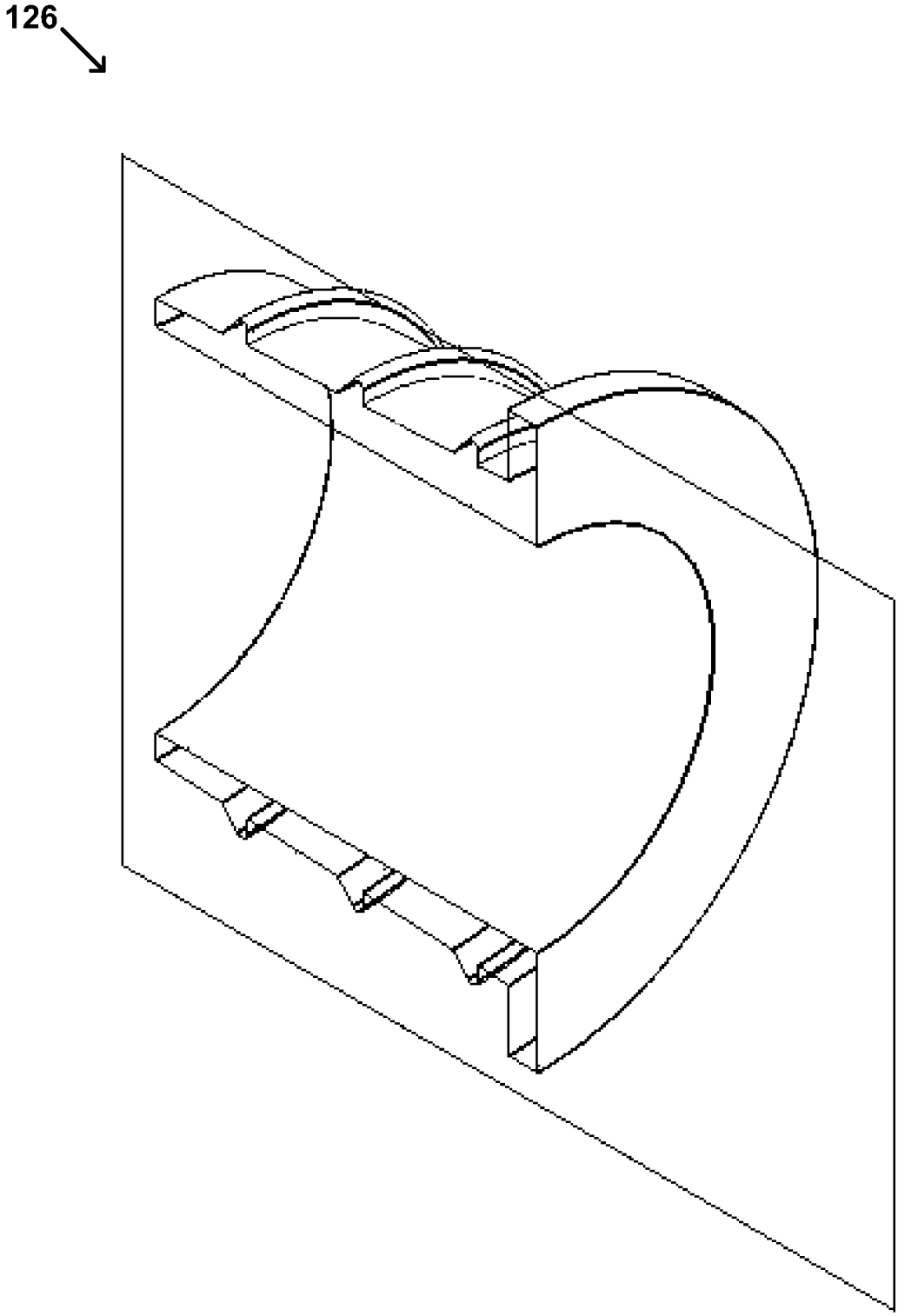
FIG. 7D is a cross-sectional perspective view of an exemplary ferrule.

FIG. 7C is a cross-sectional perspective view of an exemplary second sleeve 124. The second sleeve 124 has a first end, a second end, one or more exterior surfaces, a first interior surface, a second interior surface, and a third interior surface. The first interior surface of the second sleeve 124 is adjacent the first end. The second interior surface of the second sleeve 124 is between the first interior surface and the third interior surface. The second interior surface of the second sleeve 124 is configured to accept the exterior projection of the first sleeve 122. The third interior surface of the second sleeve 124 is adjacent the second end and configured with a smooth bore to accept the coaxial cable. The one or more external projections on the one or more exterior surfaces of the second sleeve 124 include four external projections each independently projecting from each other at an angle of ninety degrees FIG. 7D is a cross-sectional perspective view of an exemplary ferrule 126. The ferrule 126 has a first end, a second end, one or more exterior surfaces, and an interior surface. The ferrule 126 includes an exterior projection on the one or more exterior surfaces adjacent the first end. The interior surface of the ferrule 126 is configured to accept the one or more exterior surfaces of the first sleeve 122. The one or more exterior surfaces of the ferrule 126 are configured with a smooth bore to accept the first interior surface of the second sleeve 124.

Figure 7E:
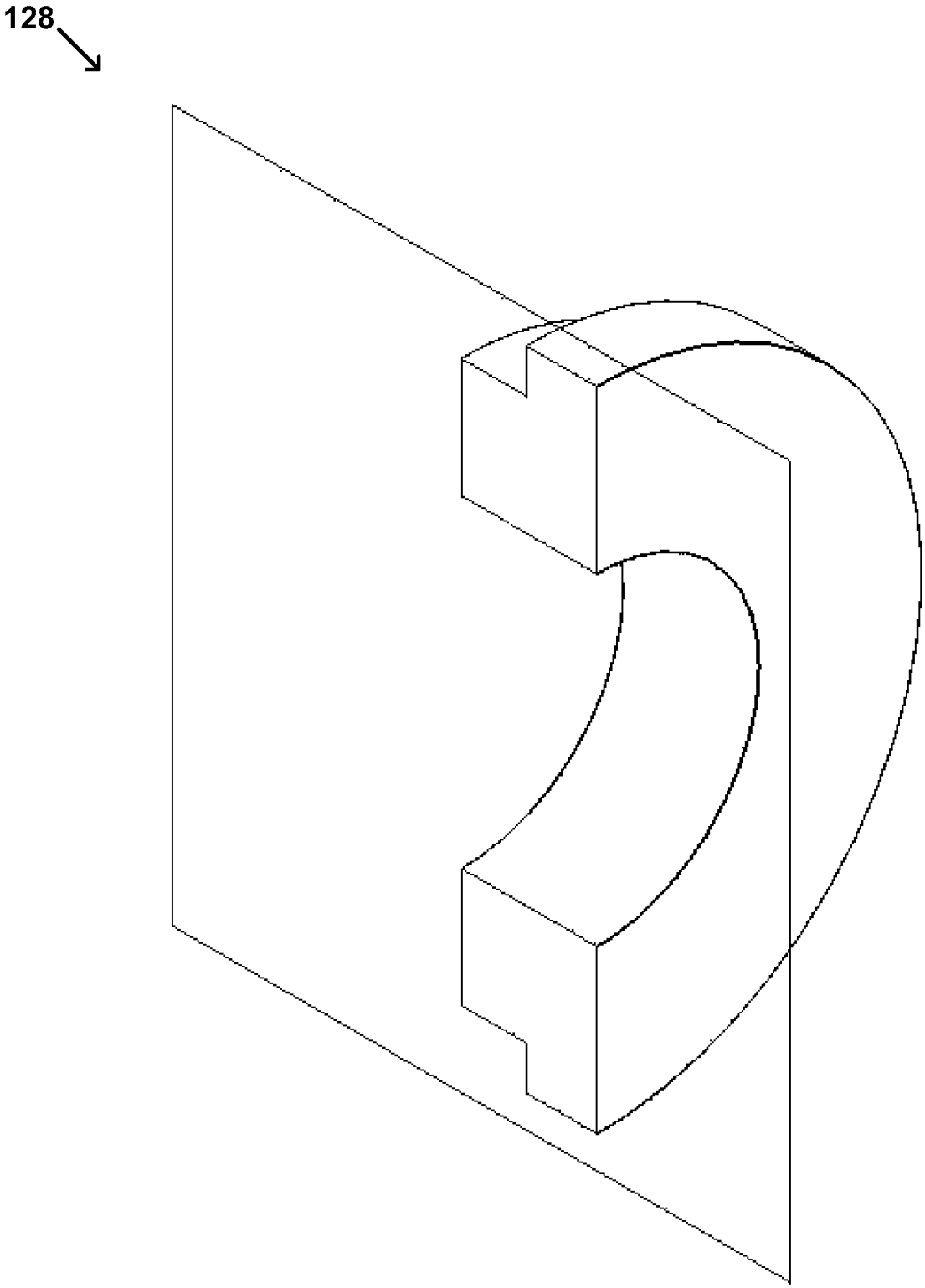
FIG. 7E is a cross-sectional perspective view of an exemplary donut.

FIG. 7E is a cross-sectional perspective view of an exemplary donut 128. The donut 128 has a first end, a second end, one or more exterior surfaces, and an interior surface. The interior surface of the donut 128 is configured with a smooth bore to accept the coaxial cable. The one or more exterior surfaces of the donut 128 are configured to accept the second interior surface of the nut 130. The donut 128 includes an exterior projection on the one or more exterior surfaces adjacent the first end.

Figure 7F:
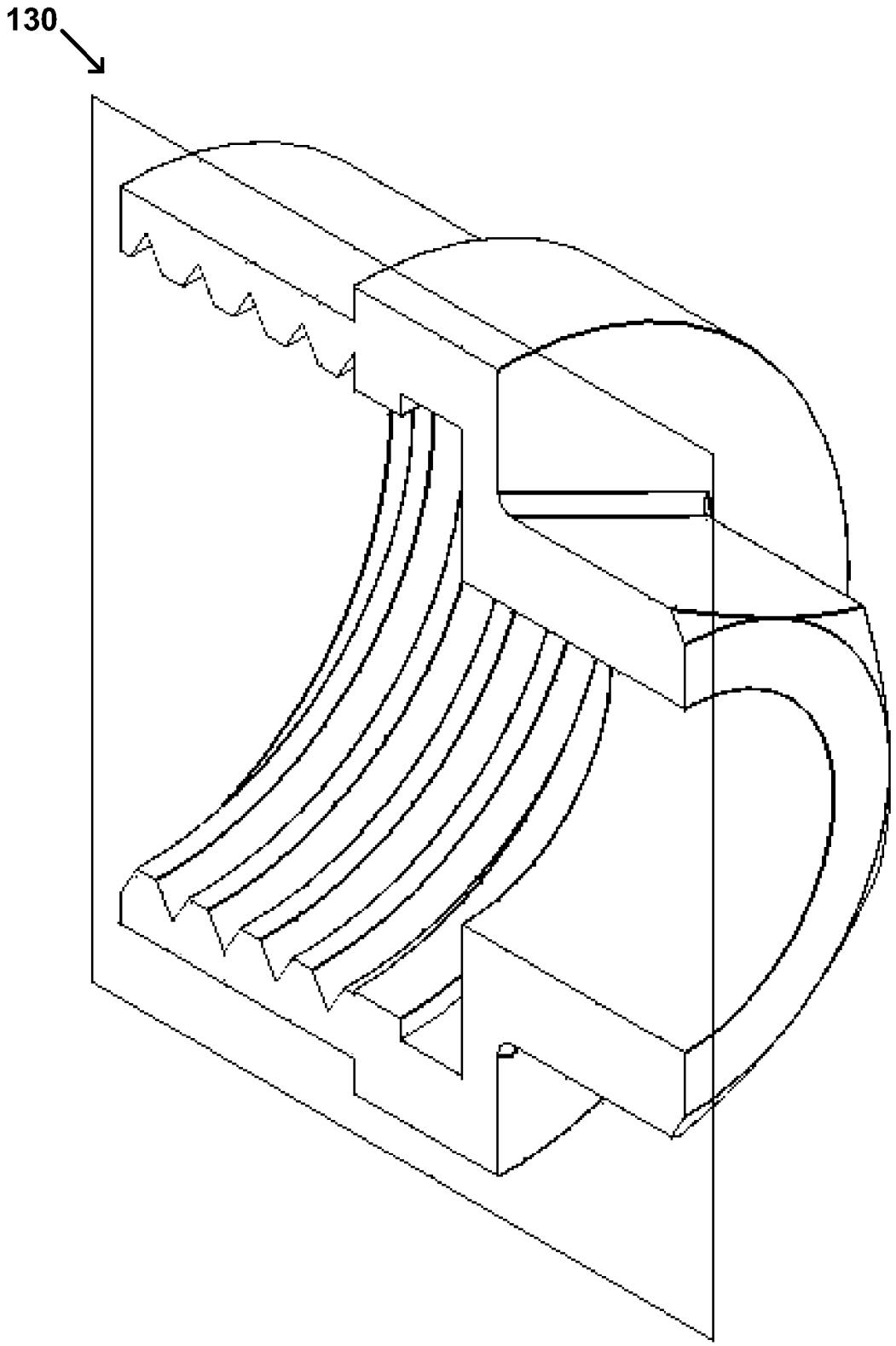
FIG. 7F is a cross-sectional perspective view of an exemplary nut.

FIG. 7F is a cross-sectional perspective view of an exemplary nut 130. The nut 130 has a first end, a second end, one or more exterior surfaces, a first interior surface, a second interior surface, and a third interior surface. The first interior surface of the nut 130 is adjacent the first end and configured with a smooth bore to accept a coaxial cable 106. The second interior surface of the nut 130 is between the first interior surface and the third interior surface. The third interior surface of the nut 130 is adjacent the second end and includes a first thread. The nut 130 includes wrench flats or a knurled outer surface on the one or more exterior surfaces adjacent the first end.

Referring now to FIG. 2, the operation and installation of the cable connection system 100 will now be described. A piece of un-prepped coaxial cable 106 is slid through the center of the nut 130 with the threaded end of the nut 130 facing the cut end of the coaxial cable 106. The coaxial cable 106 is prepped using cable television (CATV) industry standard 0.25 inch/0.25 inch prep tools. The braids are folded back and the coaxial cable 106 is inserted into the slug assembly 103 until it bottoms out. The coaxial cable 106 is positioned so that the core of the coaxial cable 106 slides inside the first sleeve 122 of the slug assembly 103, and the braid and jacket slide down the outside of the first sleeve 122. The slug assembly 103 is affixed to the coaxial cable 106 by using a cable television (CATV) industry standard compression tool. The compression action brings the ferrule 126 (assembled as part of the slug assembly) in contact with the braid of the coaxial cable 106. The compression action pinches the braid between the bottom of the slug assembly 103 and the end of the ferrule 126. At the same time, the insulated cable jacket 114 is squeezed against the first sleeve 122 inside the slug assembly 103. With the slug assembly 103 affixed to the coaxial cable 106 end, the first sleeve 122, with coaxial cable 106 is slid into the port 120. The central conductor 108 slides into the center of the insulator ring 118 at the base of the port 120. The second sleeve 124 is kept from rotating via four key slots in the port 120. The nut 130 is brought down the coaxial cable 106 and threaded into place. This compresses an insulator ring 118 to the back of the slug assembly 103. This action expands the insulator ring 118 to compress both against the coaxial cable 106, and the outer wall of the port 120 giving it an environmental seal. At the same time, this action pushes the first sleeve 122 firmly against the base of the port 120 for a good electrical contact. The outside of the port 120 can be fitted with threads for other finishes for either press fitting, or threading into device housing for use on a wide variety of products.

In the claims provided herein, the steps specified to be taken in a claimed method or process may be carried out in any order without departing from the principles of the invention, except when a temporal or operational sequence is explicitly defined by claim language. Recitation in a claim to the effect that first a step is performed then several other steps are performed shall be taken to mean that the first step is performed before any of the other steps, but the other steps may be performed in any sequence unless a sequence is further specified within the other steps. For example, claim elements that recite "first A, then B, C, and D, and lastly E" shall be construed to mean step A must be first, step E must be last, but steps B, C, and D may be carried out in any sequence between steps A and E and the process of that sequence will still fall within the four corners of the claim.

Furthermore, in the claims provided herein, specified steps may be carried out concurrently unless explicit claim language requires that they be carried out separately or as parts of different processing operations. For example, a claimed step of doing X and a claimed step of doing Y may be conducted simultaneously within a single operation, and the resulting process will be covered by the claim. Thus, a step of doing X, a step of doing Y, and a step of doing Z may be conducted simultaneously within a single process step, or in two separate process steps, or in three separate process steps, and that process will still fall within the four corners of a claim that recites those three steps.

Similarly, except as explicitly required by claim language, a single substance or component may meet more than a single functional requirement, provided that the single substance fulfills the more than one functional requirement as specified by claim language.

All patents, patent applications, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety. Additionally, all claims in this application, and all priority applications, including but not limited to original claims, are hereby incorporated in their entirety into, and form a part of, the written description of the invention.

Applicant reserves the right to physically incorporate into this specification any and all materials and information from any such patents, applications, publications, scientific articles, web sites, electronically available information, and other referenced materials or documents. Applicant reserves the right to physically incorporate into any part of this document, including any part of the written description, the claims referred to above including but not limited to any original claims.

What is claimed is:

1. A cable connection system comprising:

a nut assembly comprising:

a nut having a first end, a second end, one or more exterior surfaces, a first interior surface, a second interior surface, and a third interior surface, wherein the first interior surface of the nut is adjacent the first end and configured to accept a coaxial cable, wherein the second interior surface of the nut is between the first interior surface and the third interior surface, wherein the third interior surface of the nut is adjacent the second end and comprises a first thread; and a donut having a first end, a second end, one or more exterior surfaces, and an interior surface, wherein the interior surface of the donut is configured to accept the coaxial cable, wherein the one or more exterior surfaces of the donut are configured to accept the second interior surface of the nut;

a slug assembly comprising:

a first sleeve having a first end, a second end, one or more exterior surfaces, and an interior surface;

wherein the interior surface of the first sleeve is configured to accept the coaxial cable;

wherein the first sleeve comprises an exterior projection on the one or more exterior surfaces adjacent the second end;

a second sleeve having a first end, a second end, one or more exterior surfaces, a first interior surface, a second interior surface, and a third interior surface, wherein the first interior surface of the second sleeve is adjacent the first end;

wherein the second interior surface of the second sleeve is between the first interior surface and the third interior surface, wherein the second interior surface of the second sleeve is configured to accept the exterior projection of the first sleeve:

wherein the third interior surface of the second sleeve is adjacent the second end and configured to accept the coaxial cable; and a ferrule having a first end, a second end, one or more exterior surfaces, and an interior surface;

wherein the ferrule comprises an exterior projection on the one or more exterior surfaces adjacent the first end, wherein the interior surface of the ferrule is configured to accept the one or more exterior surfaces of the first sleeve, wherein the one or more exterior surfaces of the ferrule are configured to accept the first interior surface of the second sleeve; and a port assembly comprising:

a port having a first end, a second end, one or more exterior surfaces, a first interior surface, a second interior surface, a third interior surface, and a fourth interior surface, wherein the one or more exterior surfaces adjacent the first end of the port comprise a second thread configured to accept the first thread of the nut, wherein the first interior surface of the port is adjacent the first end and configured to accept the one or more exterior surfaces of the second sleeve;

wherein the second interior surface of the port is between the first interior surface and the third interior surface adjacent the second end, wherein the third interior surface of the port is between the second interior surface and the fourth interior surface adjacent the second end, wherein the fourth interior surface of the port is adjacent the second end of the port; and an insulative ring having a first end, a second end, one or more exterior surfaces, and an interior surface;

wherein the one or more exterior surfaces of the insulative ring are configured to accept the third interior surface of the port;

wherein the interior surface of the insulative ring is configured to accept and allow for the protrusion of a central conductor electrode in the coaxial cable from the second end of the insulative ring through the third interior surface of the port and the second end of the port.

2. The cable connection system of claim 1, wherein the nut comprises a wrench flat or a knurled outer surface on the one or more exterior surfaces adjacent the first end.

3. The cable connection system of claim 1, wherein the first interior surface of the nut is configured with a smooth bore to accept a coaxial cable.

4. The cable connection system of claim 1, wherein the interior surface of the donut is configured with a smooth bore to accept the coaxial cable.

5. The cable connection system of claim 1, wherein the donut comprises an exterior projection on the one or more exterior surfaces adjacent the first end.

6. The cable connection system of claim 1, wherein the interior surface of the first sleeve is configured with a smooth bore to accept the coaxial cable.

7. The cable connection system of claim 1, wherein the third interior surface of the second sleeve is adjacent the second end and configured with a smooth bore to accept the coaxial cable.

8. The cable connection system of claim 1, wherein one or more exterior surfaces of the second sleeve each independently comprise one or more external projections each independently projected from the first end to the second end.

9. The cable connection system of claim 8, wherein the one or more external projections on the one or more exterior surfaces of the second sleeve each independently comprise four external projections.

10. The cable connection system of claim 9, wherein the four external projections on the one or more exterior surfaces of the second sleeve each independently project from each other at an angle of ninety degrees.

11. The cable connection system of claim 1, wherein the first interior surface of the second sleeve comprises a third thread configured to accept a fourth thread on the one or more exterior surfaces of the ferrule.

12. The cable connection system of claim 1, wherein the second interior surface of the port is configured to accept the one or more external projections of the second sleeve.

13. The cable connection system of claim 1, wherein the second interior surface of the port comprises one or more indentations each independently configured to accept the one or more external projections of the second sleeve.

14. The cable connection system of claim 13, wherein the one or more indentations on the second interior surface of the port are at an angle of ninety degrees from each other.

15. The cable connection system of claim 1, wherein the interior surface of the insulative ring is tapered to allow for the protrusion of a central conductor electrode in the coaxial cable from the second end of the insulative ring through the third interior surface of the port and the second end of the port.

16. The cable connection system of claim 1, wherein the port comprises a wrench flat or a knurled outer surface on the one or more exterior surfaces.

17. A cable connection system comprising:

a nut assembly comprising:

a nut having a first end, a second end, one or more exterior surfaces, a first interior surface, a second interior surface, and a third interior surface, wherein the first interior surface of the nut is adjacent the first end and configured with a smooth bore to accept a coaxial cable, wherein the second interior surface of the nut is between the first interior surface and the third interior surface, wherein the third interior surface of the nut is adjacent the second end and comprises a first thread, wherein the nut comprises a wrench flat or a knurled outer surface on the one or more exterior surfaces adjacent the first end; and a donut having a first end, a second end, one or more exterior surfaces, and an interior surface, wherein the interior surface of the donut is configured with a smooth bore to accept the coaxial cable, wherein the one or more exterior surfaces of the donut are configured to accept the second interior surface of the nut, wherein the donut comprises an exterior projection on the one or more exterior surfaces adjacent the first end;

a slug assembly comprising:

a first sleeve having a first end, a second end, one or more exterior surfaces, and an interior surface;

wherein the interior surface of the first sleeve is configured with a smooth bore to accept the coaxial cable;

wherein the first sleeve comprises an exterior projection on the one or more exterior surfaces adjacent the second end;

a second sleeve having a first end, a second end, one or more exterior surfaces, a first interior surface, a second interior surface, and a third interior surface, wherein the first interior surface of the second sleeve is adjacent the first end;

wherein the second interior surface of the second sleeve is between the first interior surface and the third interior surface, wherein the second interior surface of the second sleeve is configured to accept the exterior projection of the first sleeve:

wherein the third interior surface of the second sleeve is adjacent the second end and configured with a smooth bore to accept the coaxial cable, wherein one or more exterior surfaces of the second sleeve each independently comprise one or more external projections each independently projected from the first end to the second end; and a ferrule having a first end, a second end, one or more exterior surfaces, and an interior surface;

wherein the ferrule comprises an exterior projection on the one or more exterior surfaces adjacent the first end, wherein the interior surface of the ferrule is configured to accept the one or more exterior surfaces of the first sleeve, wherein the one or more exterior surfaces of the ferrule are configured with a smooth bore to accept the first interior surface of the second sleeve; and a port assembly comprising:

a port having a first end, a second end, one or more exterior surfaces, a first interior surface, a second interior surface, a third interior surface, and a fourth interior surface, wherein the one or more exterior surfaces adjacent the first end of the port each independently comprise a second thread configured to accept the first thread of the nut, wherein the first interior surface of the port is adjacent the first end and configured to accept the one or more exterior surfaces of the second sleeve;

wherein the second interior surface of the port is between the first interior surface and the third interior surface adjacent the second end, wherein the third interior surface of the port is between the second interior surface and the fourth interior surface adjacent the second end, wherein the fourth interior surface of the port is adjacent the second end of the port, wherein the second interior surface of the port is configured to accept the one or more external projections of the second sleeve; and an insulative ring having a first end, a second end, one or more exterior surfaces, and an interior surface;

wherein the one or more exterior surfaces of the insulative ring are configured with a smooth bore to accept the third interior surface of the port;

wherein the interior surface of the insulative ring is tapered to allow for the protrusion of a central conductor electrode in the coaxial cable from the second end of the insulative ring through the third interior surface of the port and the second end of the port.

18. The cable connection system of claim 17, wherein the one or more external projections on the one or more exterior surfaces of the second sleeve each independently comprise four external projections.

19. The cable connection system of claim 17, wherein the four external projections on the one or more exterior surfaces of the second sleeve each independently project from each other at an angle of ninety degrees.

20. A cable connection system comprising:

a nut assembly comprising:

a nut having a first end, a second end, one or more exterior surfaces, a first interior surface, a second interior surface, and a third interior surface, wherein the first interior surface of the nut is adjacent the first end and configured with a smooth bore to accept a coaxial cable, wherein the second interior surface of the nut is between the first interior surface and the third interior surface, wherein the third interior surface of the nut is adjacent the second end and comprises a first thread, wherein the nut comprises a wrench flat or a knurled outer surface on the one or more exterior surfaces adjacent the first end; and a donut having a first end, a second end, one or more exterior surfaces, and an interior surface, wherein the interior surface of the donut is configured with a smooth bore to accept the coaxial cable, wherein the one or more exterior surfaces of the donut are configured to accept the second interior surface of the nut, wherein the donut comprises an exterior projection on the one or more exterior surfaces adjacent the first end;

a slug assembly comprising:

a first sleeve having a first end, a second end, one or more exterior surfaces, and an interior surface;

wherein the interior surface of the first sleeve is configured with a smooth bore to accept the coaxial cable;

wherein the first sleeve comprises an exterior projection on the one or more exterior surfaces adjacent the second end;

a second sleeve having a first end, a second end, one or more exterior surfaces, a first interior surface, a second interior surface, and a third interior surface, wherein the first interior surface of the second sleeve is adjacent the first end;

wherein the second interior surface of the second sleeve is between the first interior surface and the third interior surface, wherein the second interior surface of the second sleeve is configured to accept the exterior projection of the first sleeve:

wherein the third interior surface of the second sleeve is adjacent the second end and configured with a smooth bore to accept the coaxial cable, wherein the one or more external projections on the one or more exterior surfaces of the second sleeve each independently comprise four external projections each independently projecting from each other at an angle of ninety degrees; and a ferrule having a first end, a second end, one or more exterior surfaces, and an interior surface;

wherein the ferrule comprises an exterior projection on the one or more exterior surfaces adjacent the first end, wherein the interior surface of the ferrule is configured to accept the one or more exterior surfaces of the first sleeve, wherein the one or more exterior surfaces of the ferrule are configured with a smooth bore to accept the first interior surface of the second sleeve; and a port assembly comprising:

a port having a first end, a second end, one or more exterior surfaces, a first interior surface, a second interior surface, a third interior surface, and a fourth interior surface, wherein the one or more exterior surfaces adjacent the first end of the port each independently comprise a second thread configured to accept the first thread of the nut, wherein the first interior surface of the port is adjacent the first end and configured to accept the one or more exterior surfaces of the second sleeve;

wherein the second interior surface of the port is between the first interior surface and the third interior surface adjacent the second end, wherein the third interior surface of the port is between the second interior surface and the fourth interior surface adjacent the second end, wherein the fourth interior surface of the port is adjacent the second end of the port, wherein the second interior surface of the port is configured to accept the one or more external projections of the second sleeve, wherein the second interior surface of the port comprises one or more indentations each independently at an angle of ninety degrees from each other and configured to accept the one or more external projections of the second sleeve; and an insulative ring having a first end, a second end, one or more exterior surfaces, and an interior surface;

wherein the one or more exterior surfaces of the insulative ring are configured with a smooth bore to accept the third interior surface of the port;

wherein the interior surface of the insulative ring is tapered to allow for the protrusion of a central conductor electrode in the coaxial cable from the second end of the insulative ring through the third interior surface of the port and the second end of the port, wherein the first interior surface of the second sleeve comprises a third thread configured to accept a fourth thread on the one or more exterior surfaces of the ferrule.

* * * * *